United States Patent [19]

Kerr et al.

[11] Patent Number: 4,732,392

[45] Date of Patent: Mar. 22, 1988

[54] BINGO CARD DISPLAY FOR PLAYERS WITH MICROPROCESSOR CONTROLLED INDICATION OF CALLED NUMBERS

[75] Inventors: Robert G. Kerr, Las Vegas, Nev.; David C. Nelson, Santa Ana, Calif.

[73] Assignee: Robert Edwards, Kansas City, Mo. ; Trustee for Ruby Oler Trust

[21] Appl. No.: 770,399

[22] Filed: Aug. 28, 1985

[51] Int. Cl.[4] ..... A63F 3/06

[52] U.S. Cl. ..... 273/237; 273/269

[58] Field of Search ..... 273/237, 238, 138 A, 273/269

[56] References Cited

U.S. PATENT DOCUMENTS 4,133,536 1/1979 Cole ..... 273/269
4,365,810 12/1982 Richardson ..... 273/269
4,455,025 6/1984 Itkis ..... 273/269
4,475,157 10/1984 Bolan ..... 273/269
4,624,462 11/1986 Itkis ..... 273/237

*Primary Examiner*—Richard C. Pinkham
*Assistant Examiner*—MaryAnn Stoll Lastova
*Attorney, Agent, or Firm*—John E. Wagner

[57] ABSTRACT

An apparatus for playing a plurality of bingo cards, simultaneously. Sets of numbers, stored on a plurality of bingo cards, are read by a plurality of card readers. Each number called, during the play of bingo, is input manually into storage. A comparison of each called number with the previously stored sets of numbers results in a match or no match. If a match exists, an LED located below the card number lights to indicate the number on the bingo card(s) which matches the number called.

8 Claims, 32 Drawing Figures

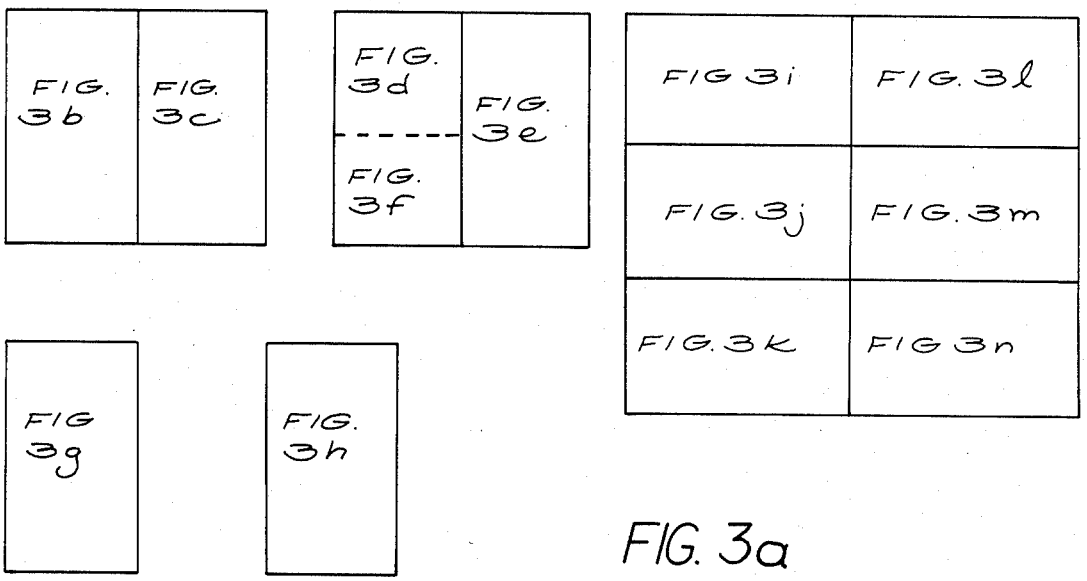
FIG. 3a
FIG. 3h
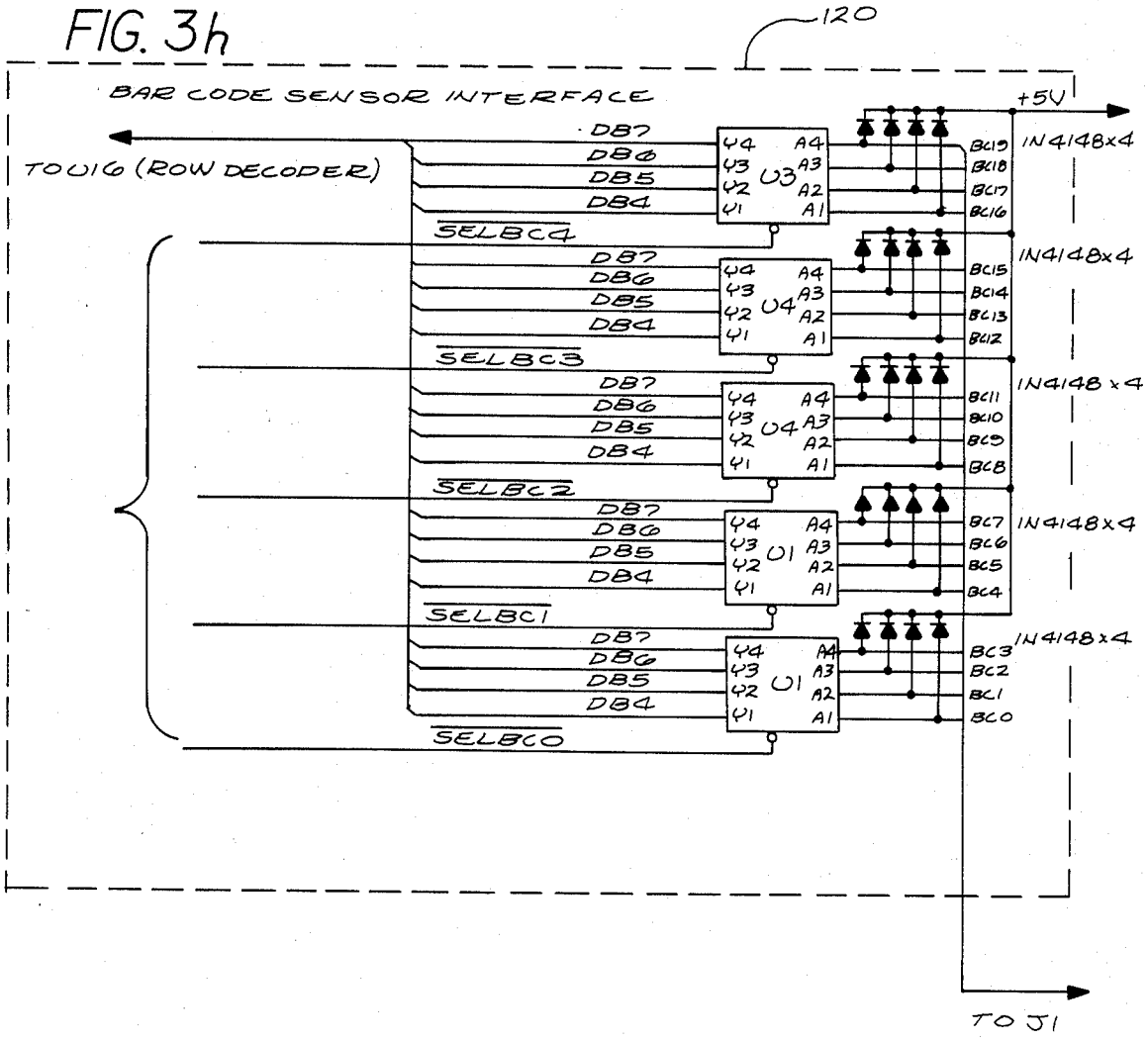

BINGO CARD DISPLAY FOR PLAYERS WITH MICROPROCESSOR CONTROLLED INDICATION OF CALLED NUMBERS

BACKGROUND OF THE INVENTION

The game of bingo has persisted through the years as a fascinating sport not only for youngsters but more particularly for adults and elderly individuals. It is easy to play, includes much suspense and excitement and is not dependent upon the preparation or skill of the player. It is a game of chance.

For many years, bingo has been a mainstay of fund raising for non-profit organizations such as churches and lodges. Many have entire auditoriums filled one or more nights per week with avid players who find challenge as well as entertainment in the game.

In recent years, with specific legislation in many states legalizing the play of games such as bingo for cash for the benefit of non-profit organizations without the guise of free but "contribution" type support to the sponsoring organization, bingo has further grown in popularity.

Although bingo is strictly a game of chance, a player may increase his chance for winning through the simultaneous playing of a number of cards in each game. This requires rapid perception of a number called, rapid eye movements over the field of up to 15 cards lying in front of the player, marking each card or paper game sheet, analyzing each card to see if the number produces a win according to the rules of the particular game, and announcing a win, if appropriate. If not, the player must be prepared for the next number to be called. Usually this must be performed within a period of seconds, the typical measurement of time between sequential calls of the numbers in a game.

In the past, a number of devices have been developed which attempt to aid the player or simulate play in such a way that the player becomes a somewhat passive participant in the game. Aiding without taking over the game by machine has not been accomplished.

Examples of several United States patents which show attempts to automate the game of bingo are:

U.S. Pat. No. 2,333,002, S. M. Goloborodko, Oct. 26, 1943;

U.S. Pat. No. 2,760,619, J. L. Peak, Aug. 28, 1956;

U.S. Pat. No. 3,671,041, Taylor, et al, June 20, 1972;

U.S. Pat. No. 4,080,596, Keck, et al, Mar. 21, 1978;

U.S. Pat. No. 4,365,810, J. Richardson, Dec. 28, 1982;

U.S. Pat. No. 4,378,840, Gluz, et al, Apr. 5, 1983.

In unrelated fields, various types of consoles have been developed for operator use as in control panels for public utilities and as computer stations. Examples of such disclosures are in the following United States patents:

U.S. Pat. No. 3,187,321, S. L. Kameny, June 1, 1965;

U.S. Pat. No. 3,283,318, J. C. Bramer, Jr., Nov. 1, 1965;

U.S. Pat. No. 3,803,580, R. C. Shattuck, Apr. 9, 1974.

In a number of other games than bingo and as aids to teaching, displays or consoles have been developed to aid the player or student. Examples of such displays and consoles are shown in the following United States patents:

U.S. Pat. No. 3,149,841, J. F. Hullman, Sept. 22, 1964;

U.S. Pat. No. 3,751,825, J. H. Barrett, Aug. 14, 1973.

All of these devices fail to provide a bingo player with the desired degree of assistance in play without overwhelming him and removing the pleasure of the game play.

SUMMARY OF THE INVENTION

The present invention relates to a bingo game which is played with bingo cards, each of which has a set of 24 numbers between 1 and 75 under its B, I, N, G and O columns, plus a free space under its N column, and where each individual number on the bingo card is covered when it is called from a random number source during the bingo game. The present invention is an apparatus for electronically assisting a player by displaying the called and covered numbers on each of a plurality of bingo cards with a single manual input of each called number, comprising (1) a microprocessor/storage means for storing and accessing all numbers called and each set of numbers on each of the plurality of bingo cards; (2) an inputting means interconnected to the microprocessor/storage means for manually inputting into storage each called number; (3) a plurality of reader means, each reader means interconnected to the microprocessor/storage means, for automatically reading each set of numbers on at least two bingo cards and inputting each set of numbers into storage; (4) a means interconnected to the microprocessor/storage means for indicating the called numbers as they exist on each of the plurality of bingo cards; and, (5) a means for manually enabling the erasing from storage of all called numbers after the end of each bingo game.

The apparatus of the present invention may further include means for interconnecting at least two apparatus where one such apparatus acts as a master apparatus and the others as slave apparatus so that the inputting means of the master apparatus inputs called numbers into its own storage and the storage of each of the slave apparatus, and, the player's manual input of called numbers in the master apparatus causes the master and slave apparatus to display the called numbers as they exist on all of the plurality of bingo cards read by the master and slave apparatus.

The apparatus of the present invention may use a plurality of dual bingo cards, each having two individual sets of markings, wherein each set of markings can be translated by each reader means into the set of numbers on each of the dual bingo cards. This dual bingo card may be read by dropping it into the reader means.

The apparatus may further include means for verifying the correctness of the set of numbers read from each bingo card. In addition, the apparatus may further include means for indicating that a number manually inputted by the player as a called number had already been inputted during a particular bingo game. A means for displaying each of the called numbers inputted by the player may also be included in the present apparatus.

DETAILED DESCRIPTION OF THE INVENTION

The present invention relates to an apparatus for electronically assisting a bingo player. Bingo is a game which is played with bingo cards, each of which has a set of 24 numbers between 1 and 75 under its B, I, N, G and O columns, plus a free space under its N column. Each individual number on the bingo card is covered when it is called from a random number source during each bingo game. There are many types of bingo games from those which require an entire "blackout" of all numbers on a card to covering only the four corner numbers on the card to win.

From the beginnings of the game of bingo, bingo players have attempted to increase the number of cards that they will play on a particular occasion in order to increase their chances of winning. However, since (1) the numbers called come every 3 to 5 seconds, (2) each called number must be covered or marked on each individual card and (3) each card must be monitored for a winning arrangement of covered numbers, there is a practical limit to the number of cards an individual player can competently play.

The present invention allows the player to competently play a greatly increased number of bingo cards by, among other things, displaying each called number as they exist on each played bingo card with a single manual input of each of the called numbers. This enables the player to simply enter the called number and peruse each of the played bingo cards to see if one or more of them have won the game.

Figure 1A:
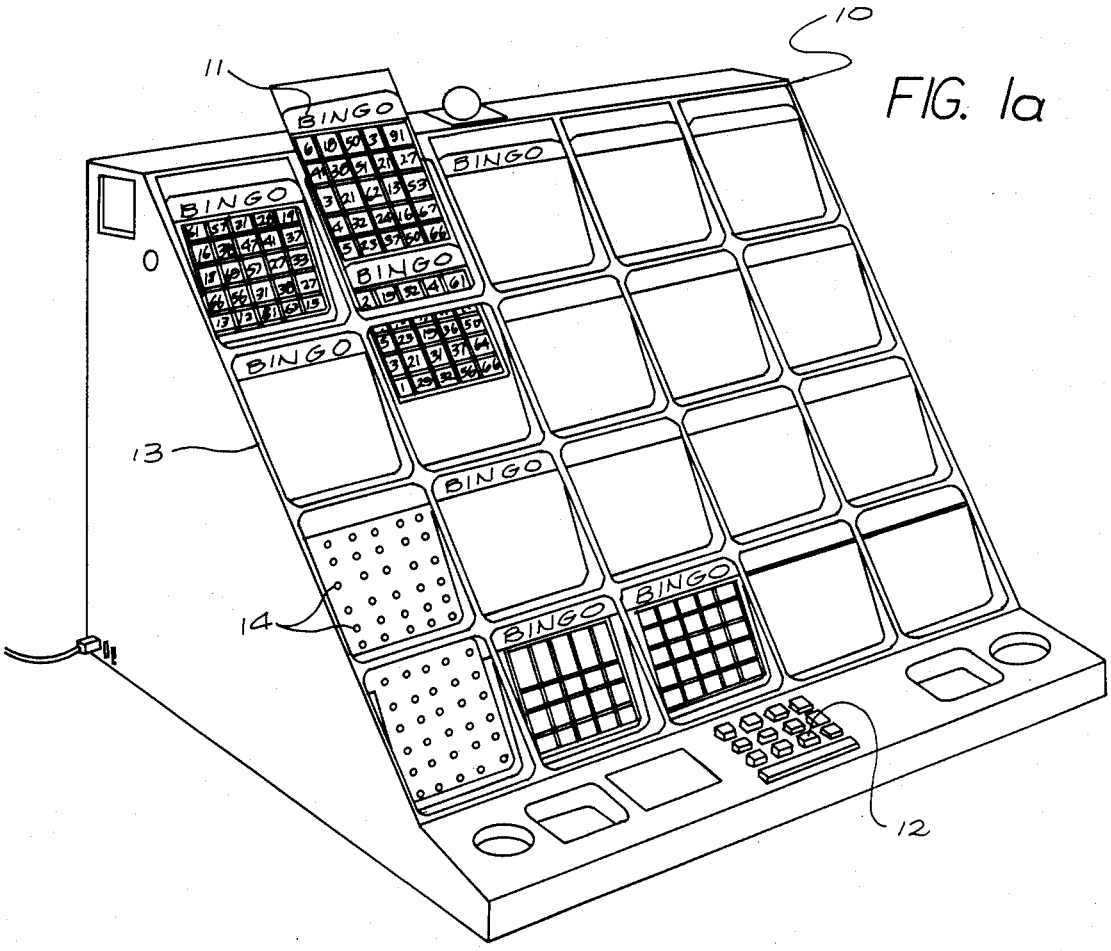
FIG. 1*a* is a perspective view of the bingo player apparatus of the present invention.

Referring to FIG. 1*a*, the preferred embodiment of the electronic assisted bingo playing machine 10 (hereinafter "bingo player 10") is shown. Preferably, the bingo player 10 will use dual bingo cards 11 which have two separate bingo cards imprinted on them. These dual bingo cards 11 are dropped into the bingo player 10 and each set of 24 numbers on each of the individual bingo cards are read by the bingo player 10. The preferred embodiment of the bingo player 10 can assist in the playing of 10 dual bingo cards 11 (20 individual bingo cards).

Both the dual bingo card 11 and the process of reading the set of numbers on each bingo card will be discussed in detail later. Suffice it to say at this point that the sets of 24 numbers from each individual bingo card played are read by the bingo player 10 and are stored. These stored sets of bingo card numbers are then compared with the called numbers which are manually inputted by the player via keyboard 12. The called numbers are also stored by the bingo player 10 but only until the player tells bingo player 10 (via keyboard 12) that the game is over. When a called number exists on one or more of the bingo cards in the bingo player 10, the bingo player 10 typically causes an LED in a 5×5 LED matrix 14 to light under the number(s) on the card(s) which has (have) been called and exist(s) on the card(s). Preferably, the bingo player 10 will display the called number inputted by the player on display 13 before the number is allowed to be stored in order to avoid any mistakes in inputting the number actually called.

Figure 1B:
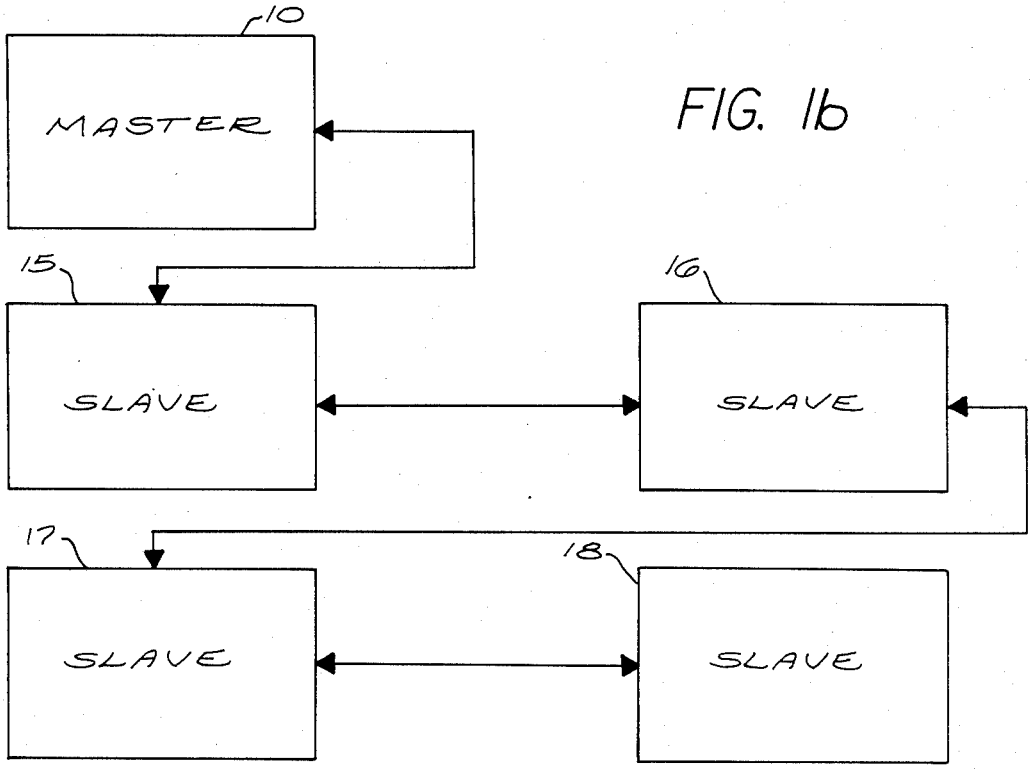
FIG. 1*b* is a block diagram of the interconnection of master and slave bingo player apparatus.

Referring to FIG. 1*b*, numerous bingo players 10 can be cascaded together so that a single player can play 20 bingo cards on each of the chosen number of bingo players 10 employed. In order to prevent the player from having to input the called numbers in each of the cascaded bingo players 10, the cascaded bingo players 10 are interconnected so that one is a master 10 and the others 15 through 18 are slaves. Thus, the player must simply input the called numbers via the keyboard 12 of the master bingo player 10 in order to cause the slave bingo players 15 through 18 to display the called numbers as they exist on their bingo cards.

Figure 4:
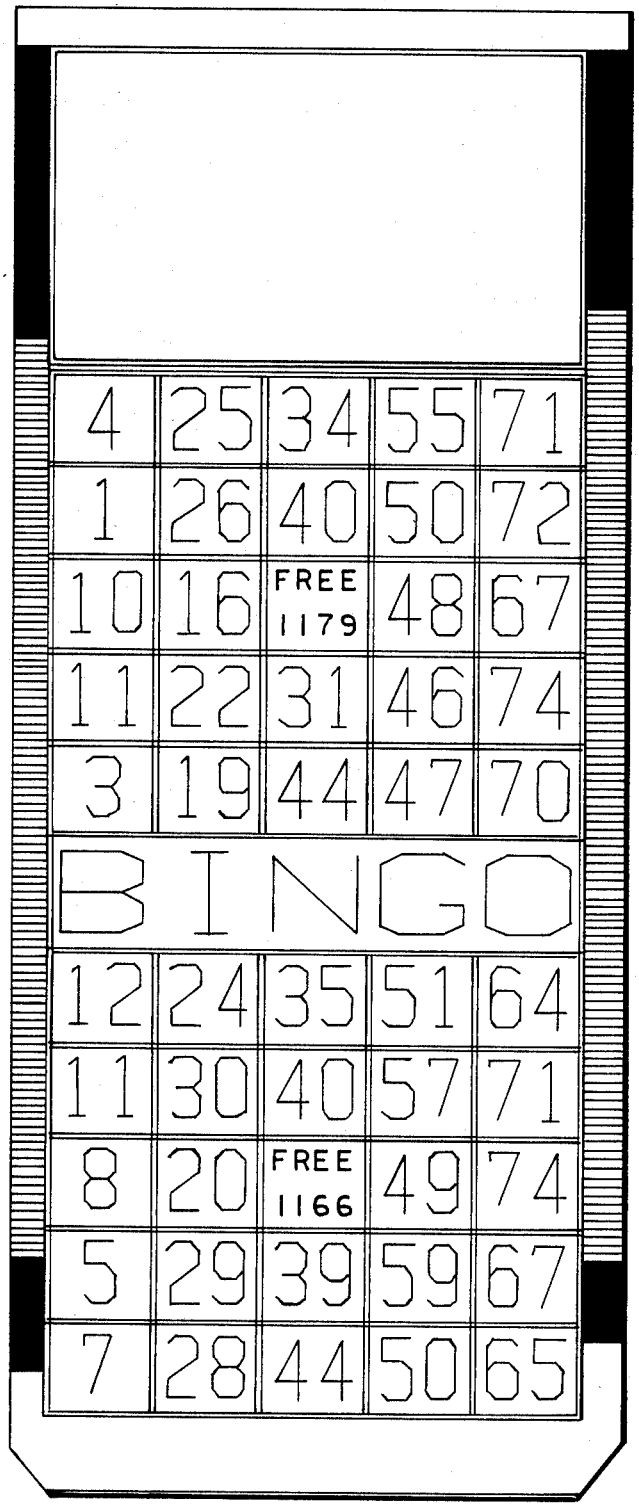
FIG. 4 is a front elevational view of the dual bingo card of the present invention; and, FIGS. 5*a* through 5*n* are a flow diagram of the logic of the programming of the main processor.

Referring momentarily to FIG. 4, the preferred embodiment of the dual bingo card 11 is shown. The dual bingo card 11 is preferably constructed of a clear semi-rigid plastic with opaque markings for the two sets of 24 numbers and the two free spaces 46 and 48. In addition, the markings will preferably include two barcodes 42 and 44, each barcode containing information representing the set of 24 numbers for each bingo card and two verification numbers (discussed later).

Figure 2:
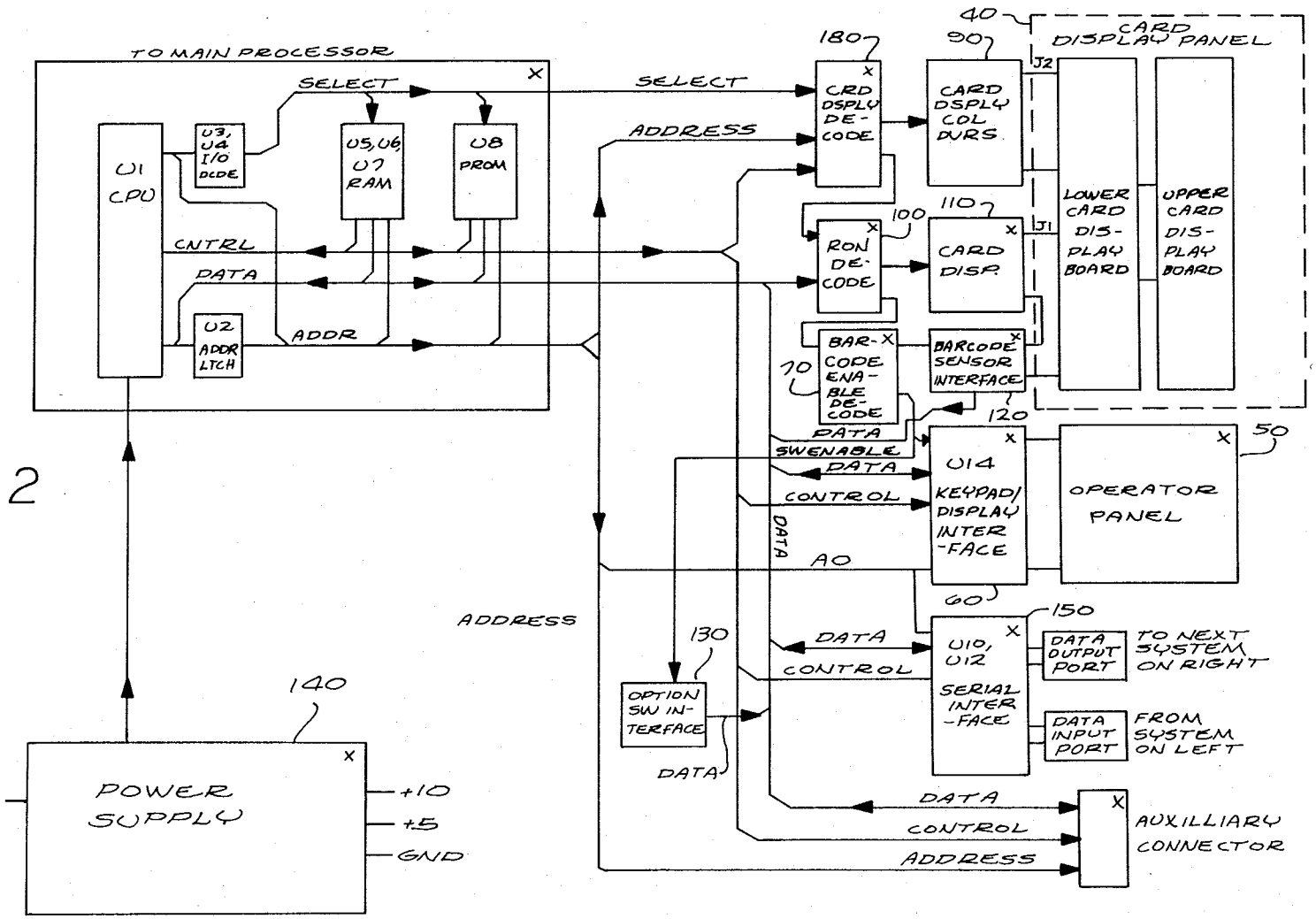
FIG. 2 is an electronic block diagram of the electronics of the bingo player apparatus of the present invention.

Referring now to FIG. 2, a block diagram of the electronics of the preferred embodiment of the bingo player 10 is shown. The heart of the electronics is the main processor circuit 20 which controls the other components of the electronics and stores the called numbers and each set of 24 numbers on each bingo card played. In a card display panel circuit 40 there are preferably 10 barcode sensor assemblies (42 of FIGS. 3*i* and 3*j*), with each barcode sensor assembly 42 being responsible for reading the barcodes (42 and 44 of FIG. 4) of one of the dual bingo cards 11 (FIG. 4). The barcode sensor assemblies 42 are enabled by the main processor 20 via row decode circuit 100, barcode enable decode circuit 70, and barcode sensor interface circuit 120. The player simply drops the dual bingo card 11 (FIG. 4) into a slot 19 (shown only in FIG. 1*a*) and before any data is transmitted, a signal is sent to the main processor 20 indicating that a dual bingo card 11 is to be read via barcode sensor interface circuit 120.

Before the data is transmitted by the barcode sensor assemblies 42, the main processor 20 opens its data lines to receive the barcode information from each of the barcodes 42 and 44 via barcode enable decode 70 and barcode sensor interface 120 circuits. The main processor 20 stores each individual number of the two sets of 24 numbers in each dual bingo card 11 and the position of each number.

Figure 3B:
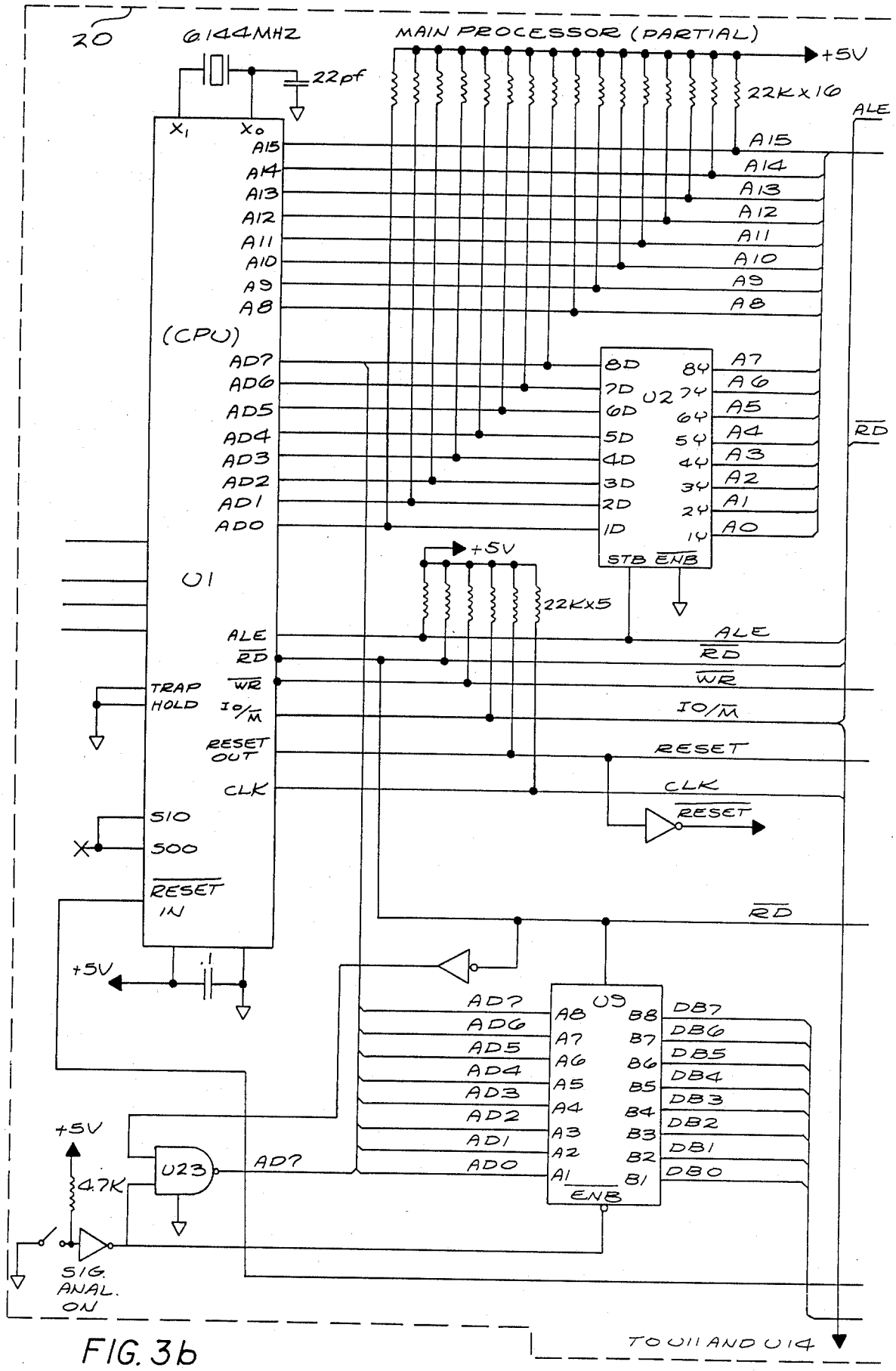
FIGS. 3*b* and 3*n* compose a detailed electronic schematic diagram of the electronics of the bingo player apparatus of the present invention.
Figure 3C:
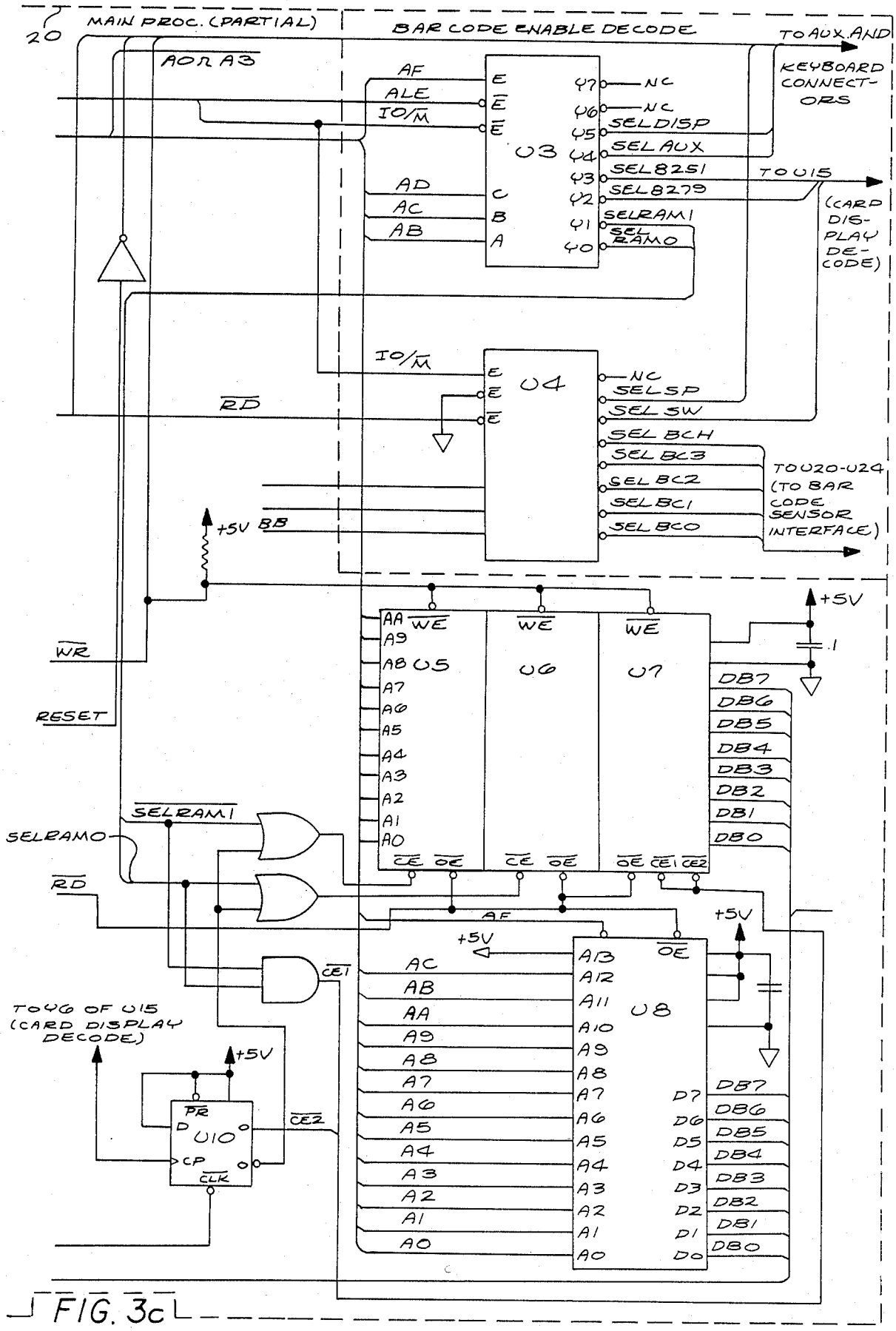
FIG. 3*a* is a graphical depiction of how to arrange FIGS. 3*b* through 3*n;*
Figure 3D:
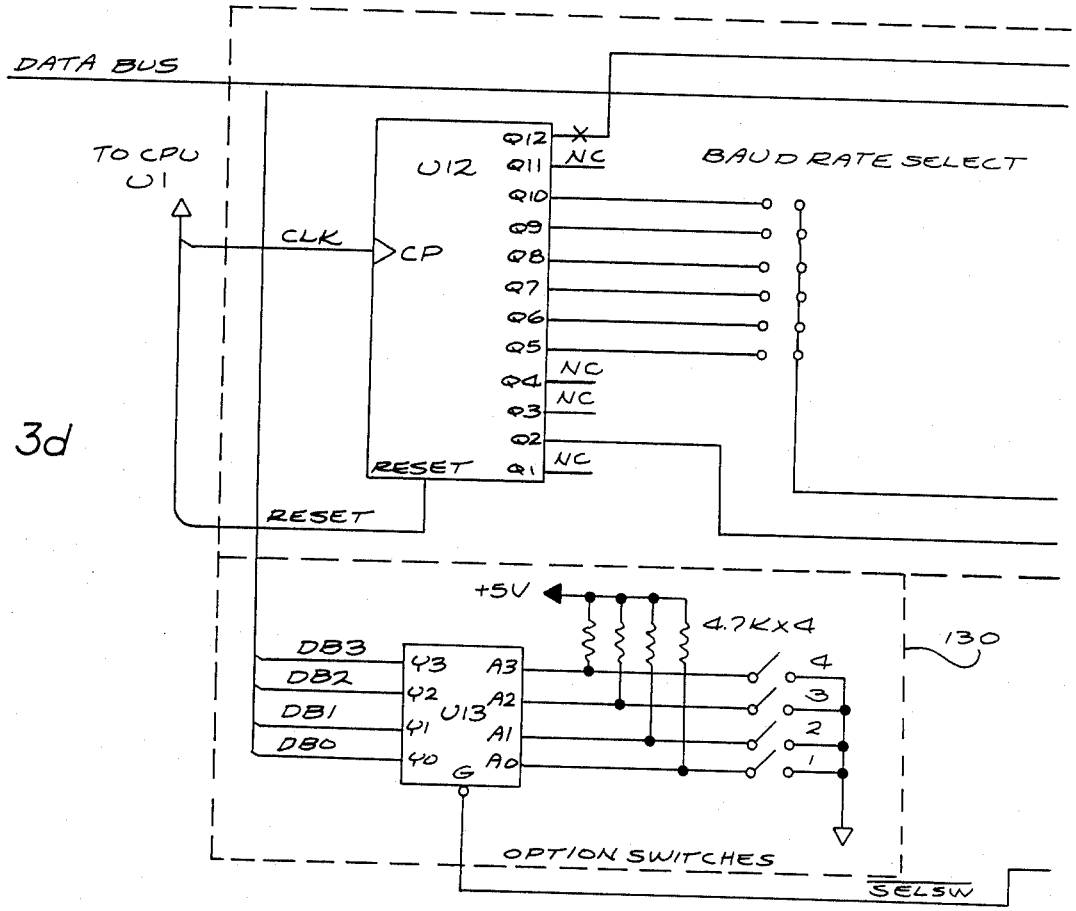
Figure 3F:
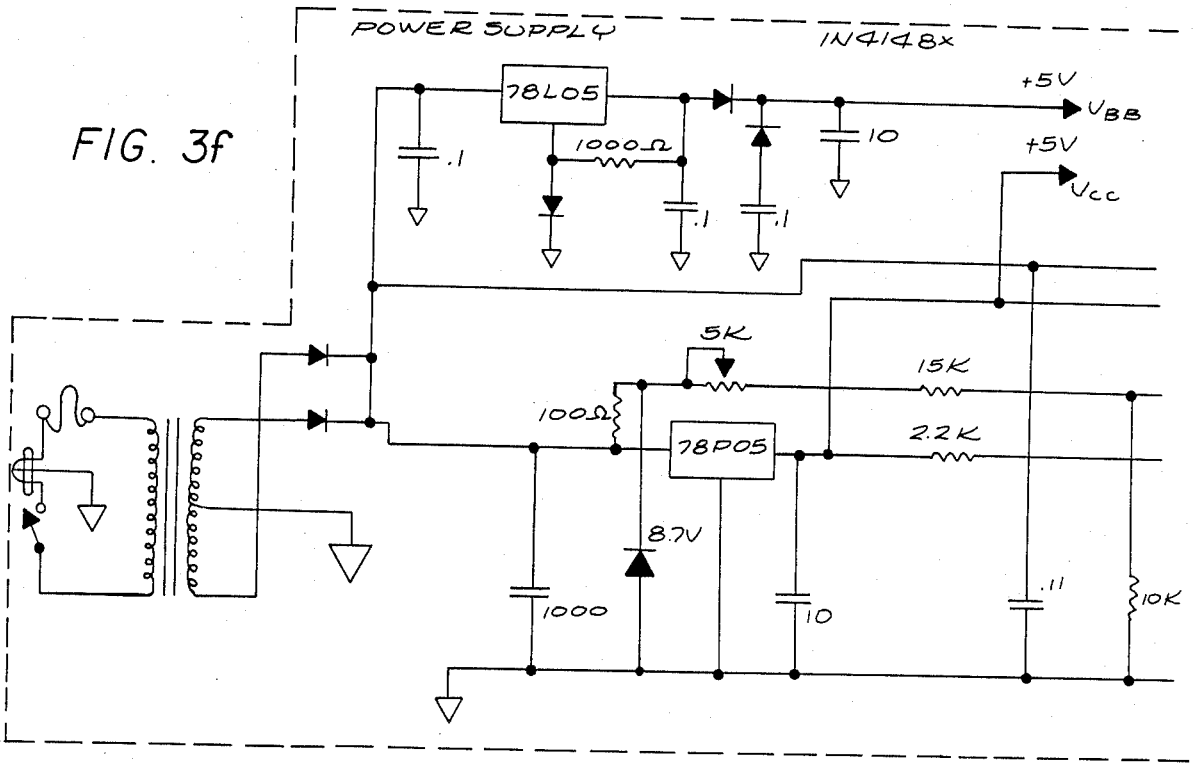
Figure 3E:
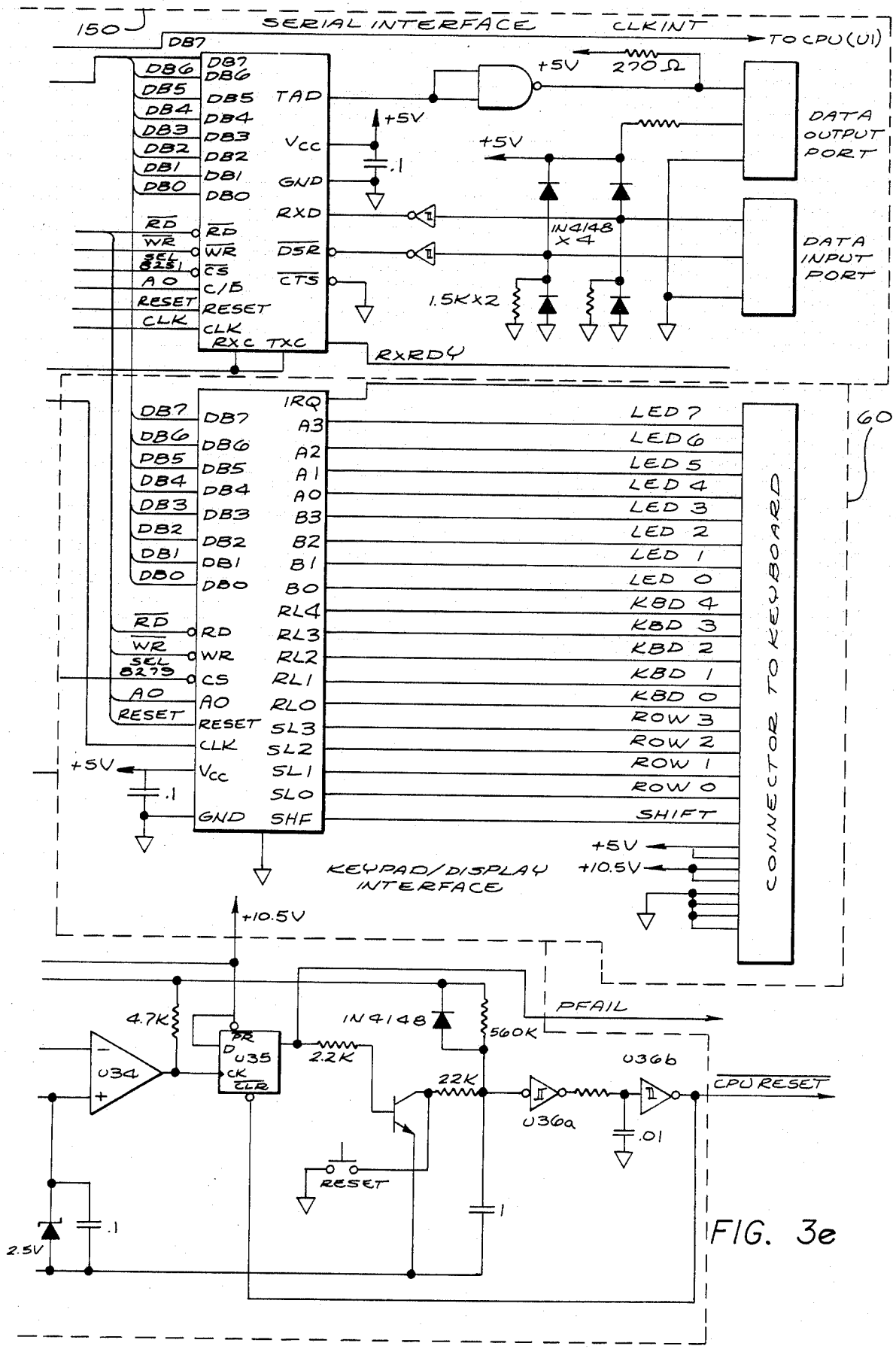
Figure 3G:
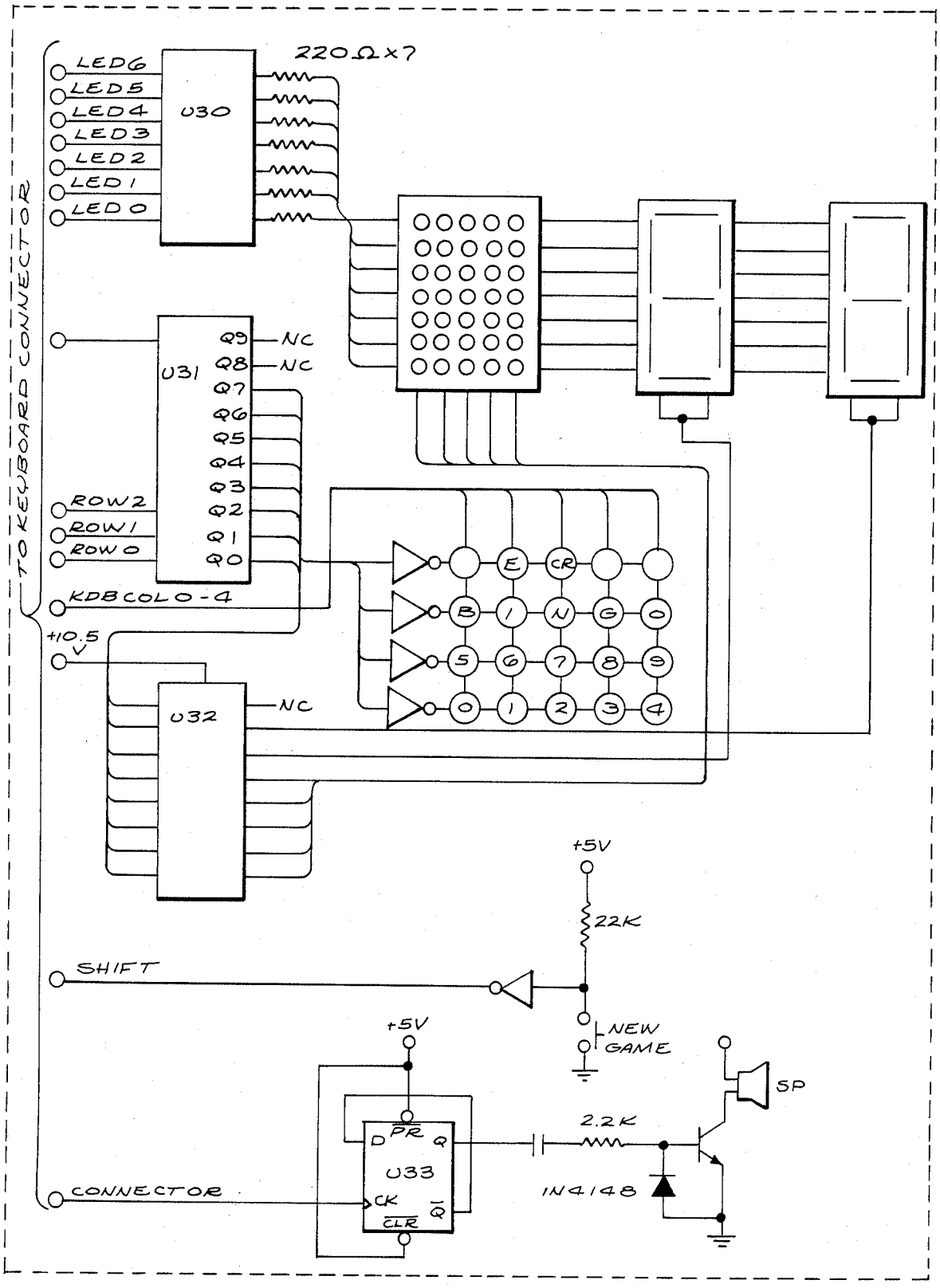
Figure 3I:
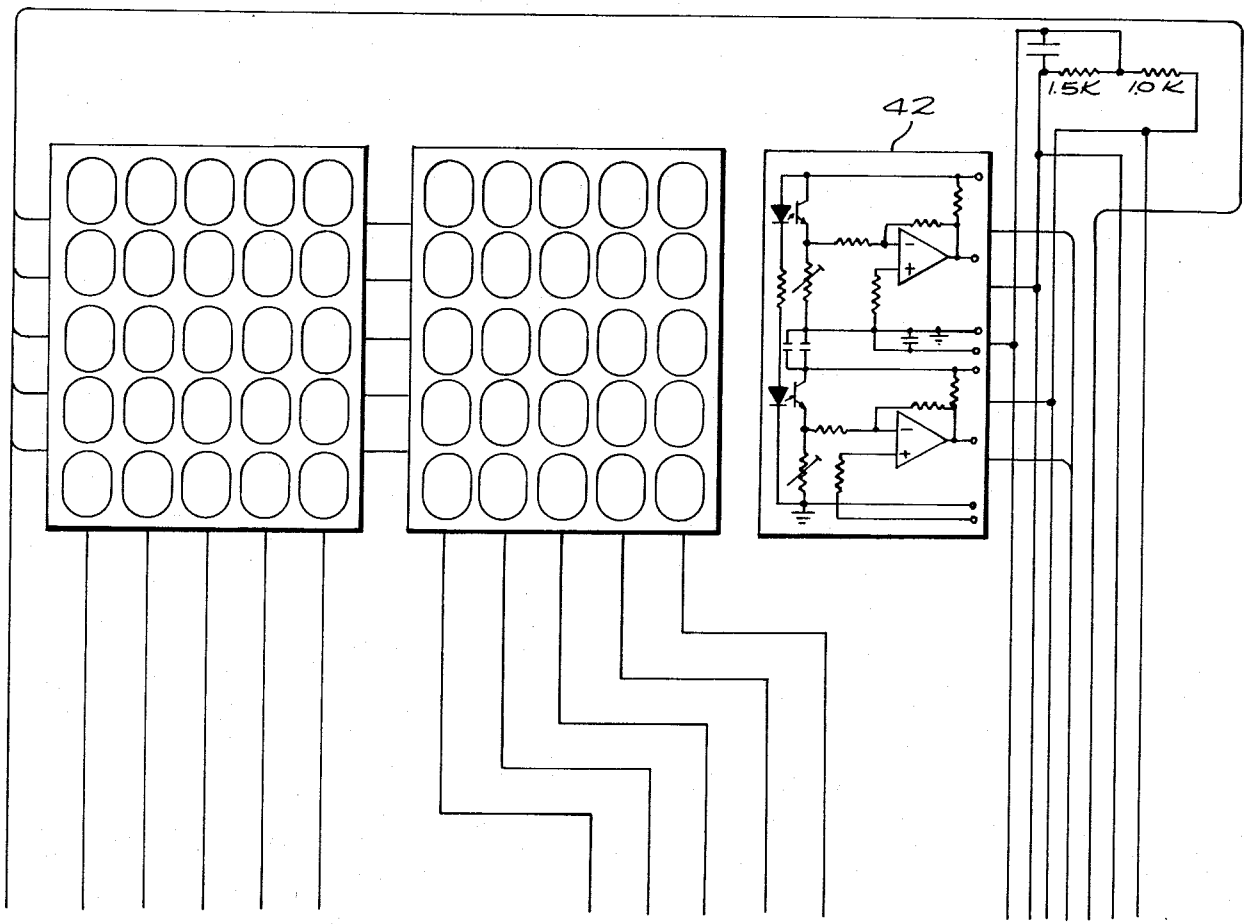
Figure 3J:
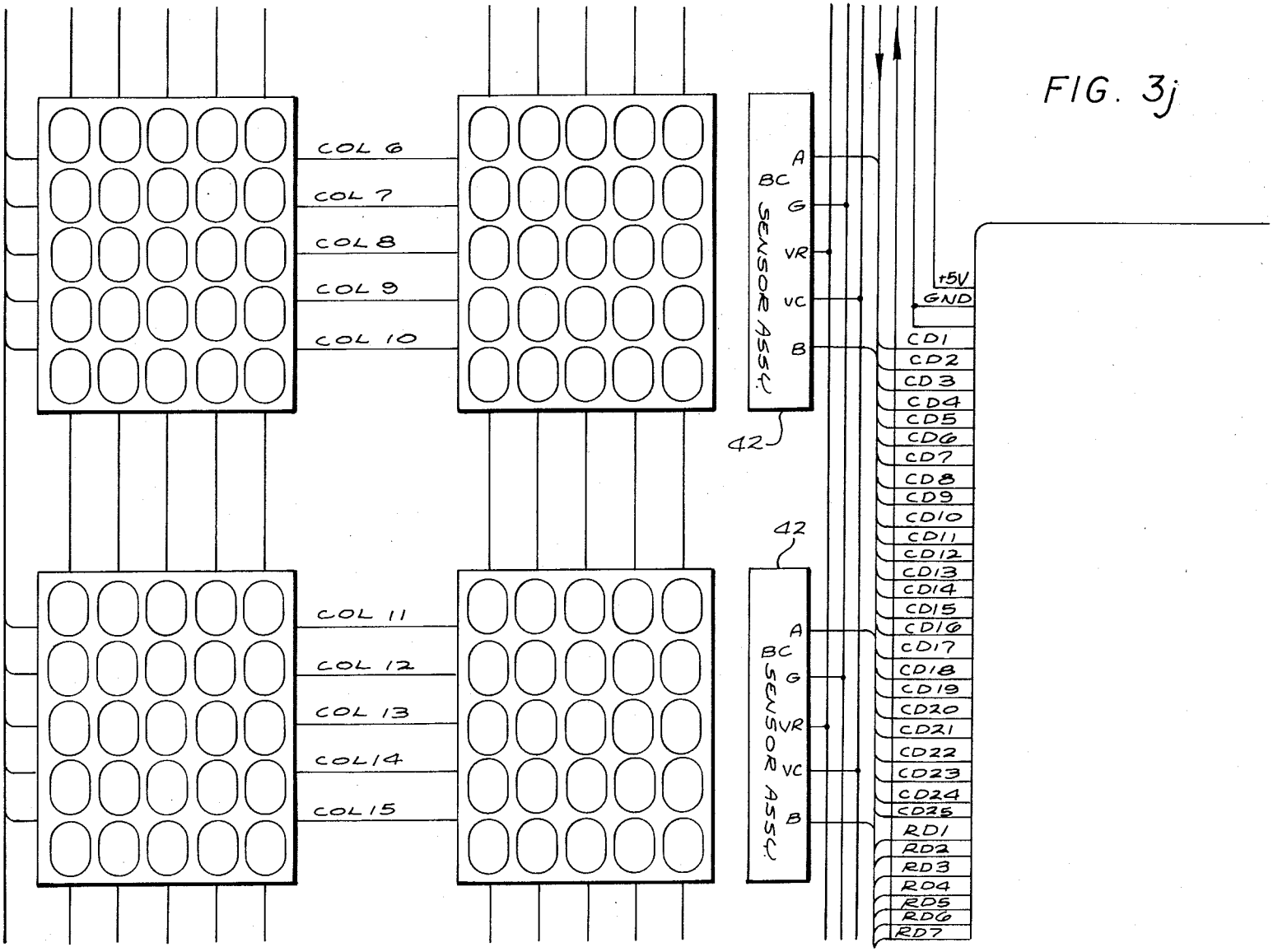
Figure 3K:
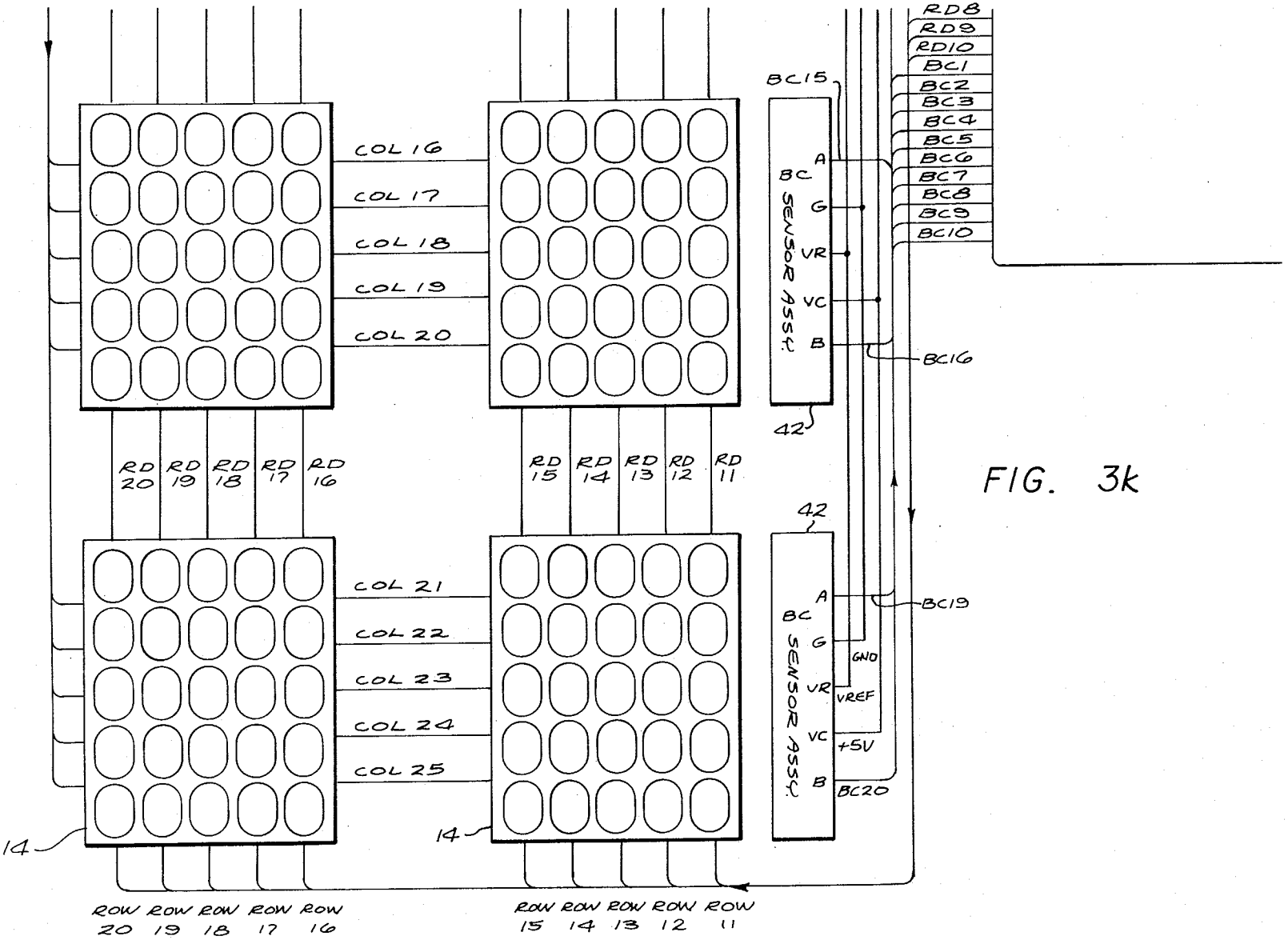
Figure 3L:
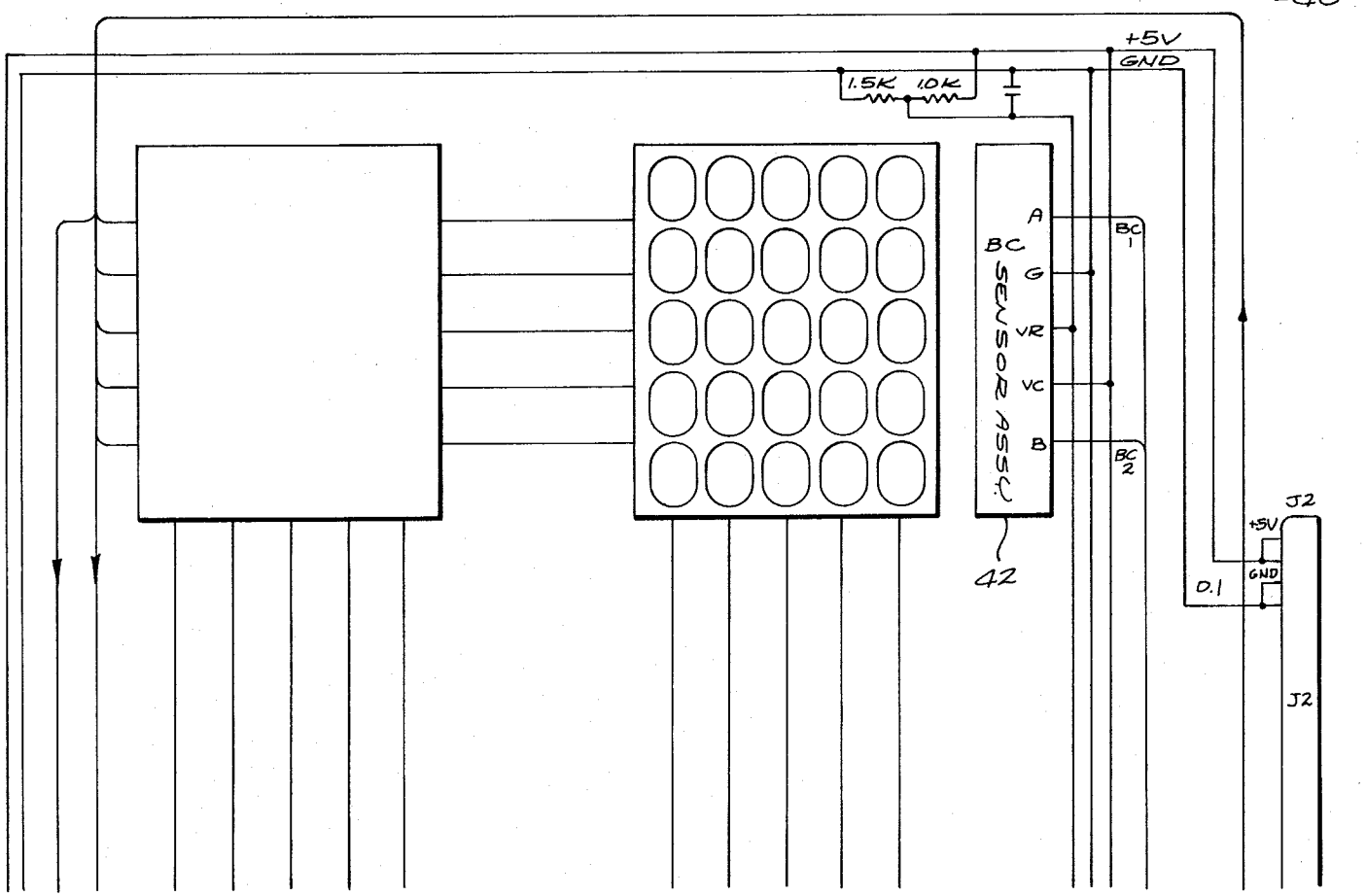
Figure 3M:
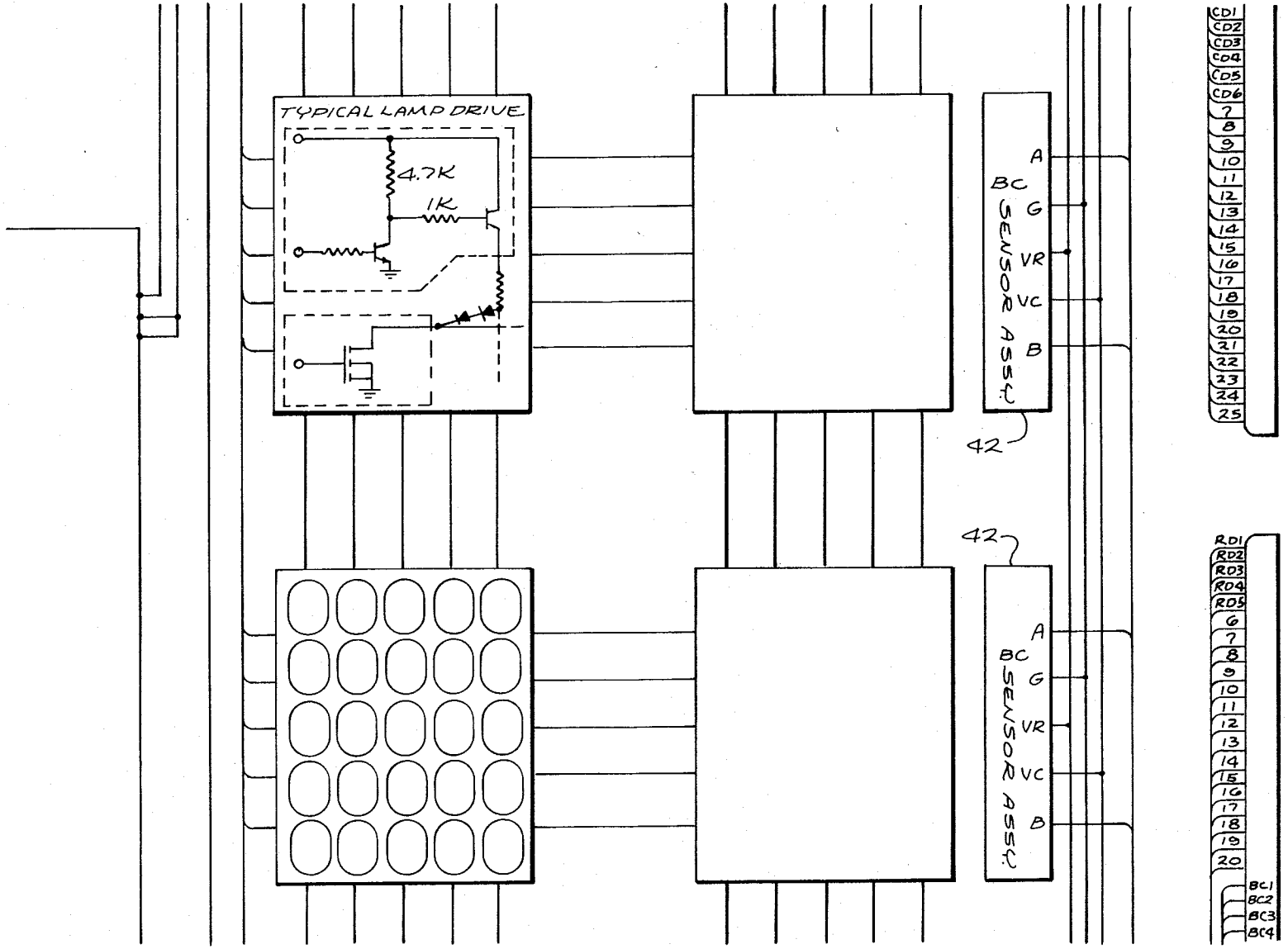
Figure 3N:
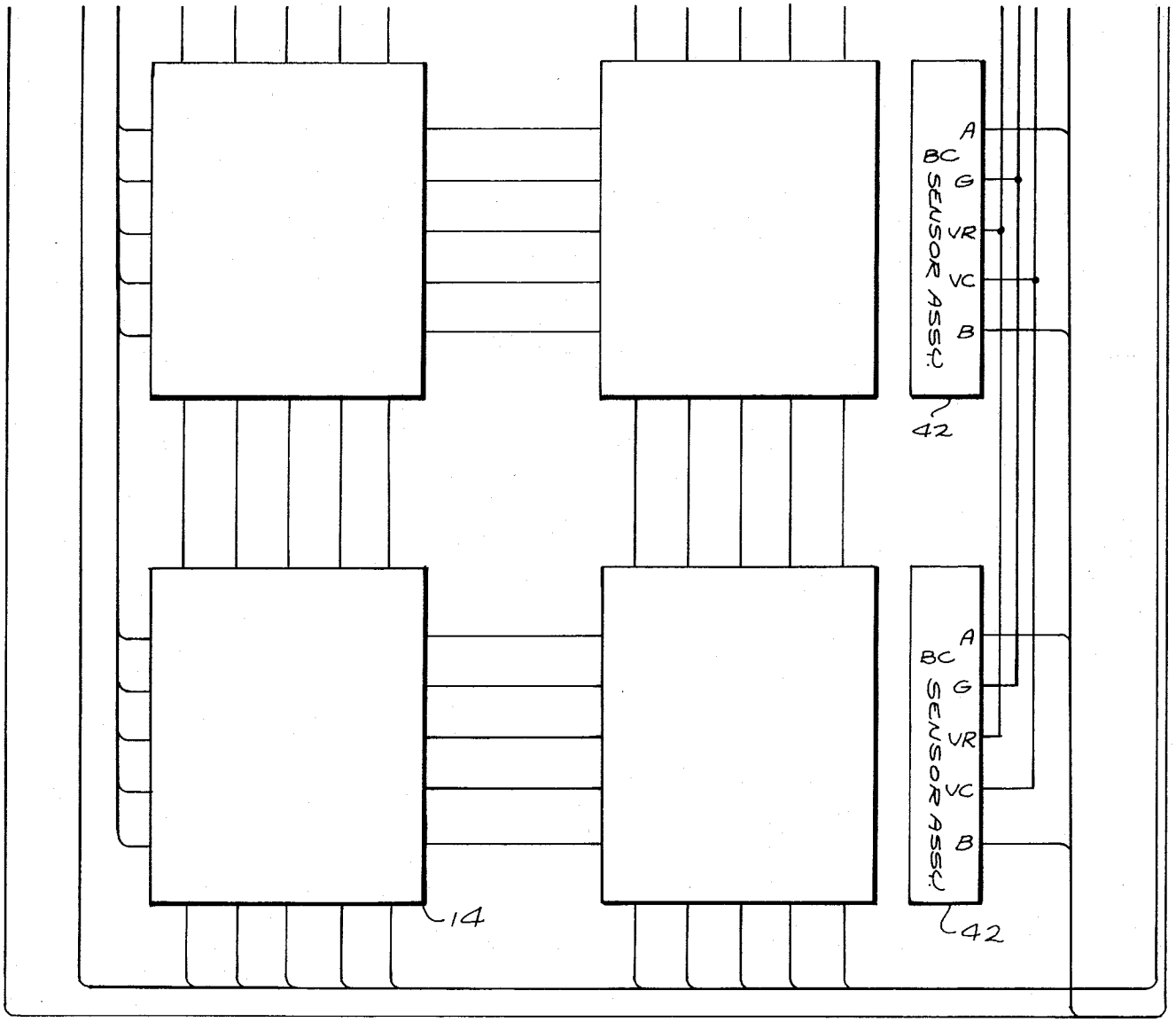

The card display panel 40 also preferably contains 20 5×5 matrix LED's (14 of FIGS. 1*a*, 3*i* and 3*j*). Each of the individual LED's in each 5×5 matrix LED's 14 is individually controllable by the main processor 20 via card display decode 80, card display column drivers 90, row decode 100 and card display row drivers 110 circuits. After the player inputs a called number via keyboard 12 (FIG. 1*a*), the main processor 20 compares the inputted called number with the numbers stored for each of the bingo cards on the dual bingo cards 11 played. If any one or more of the bingo cards has this called number on it, the main processor 20 causes the LED of the 5×5 matrix LED's 14 which is located under the number on the dual bingo card 11 to light, indicating that that number has been called. Thus, a single entry of one called number will display all of the called numbers as they exist on each of the bingo cards on the ten dual bingo cards 11 in the bingo player 10. In addition, the free spaces 46 and 48 (FIG. 4) can be made to light continuously if the the set of 24 numbers has been properly verified by the main processor 20. More regarding the process of verification will be discussed under the description of the basic operation of the bingo player 10.

When there are one or more slave bingo players (15 through 18 of FIG. 1*b*), then serial interface circuit 150 will cause the slave bingo player(s) (15 through 18 of FIG. 1*b*) to display the called number entered in the master bingo player (10 of FIG. 1*b*) as that number may exist on each of the bingo cards on the dual bingo cards 11 played on the slave bingo players (15 through 18). Thus, where there are slave bingo players (15 through 18) employed, the player must only enter each called number once to achieve the display of called numbers as they exist on all bingo cards on all dual bingo cards 11 whether on the master 10 or slave (15 through 18) bingo players.

The keyboard 12 and display 13 (of FIG. 1*a*) are accessible to the main processor 20 via keypad/display interface 60 and operator panel circuit 50. Thus, through these circuits the player may enter the called numbers and confirm the called number as it is displayed on display 13 (FIG. 1*a*) before it is entered into the main processor 20 storage.

The electronics of the bingo player 10 is preferably powered by power supply 140 which includes a circuit to reset the main processor 20 in the event of a power failure. This power failure reset feature will be discussed more fully when the electronics of the bingo player 10 is discussed in detail.

The bingo player 10 may also have an auxiliary connector 160 which is connected in parallel to the main processor's 20 data, control and address lines to enable the main processor 20 to be connected to a all possible numbers display (unshown) which can display all of the possible numbers from 1 through 75, inclusive, that have been called. The auxiliary connector 160 can also be used to allow the main processor 20 to communicate with other devices (unshown).

The electronics of the bingo player 10 also preferably contains an option switch interface circuit 130 which has as it purpose to inform the main processor 20 that an external device (unshown) is interconnected to the auxiliary connector 160.

Referring now to FIG. 3*a*, the manner by which FIGS. 3*b* through 3*j* should be arranged is shown. Now referring to FIGS. 3*b* through 3*j*, the detailed electronic schematic diagram of the electronics of the preferred embodiment of the bingo player 10 is shown. The main processor 20 is preferably composed of an 8085 microprocessor U1, 5517 RAM U5 and U6 and 5533 RAM U7, a 2674 PROM U8 and associated components. Power supply 140 uses operational amplifier U34, high impedance driver U35 and inverting Schmitt triggers U36*a* and U36*b* to cause the microprocessor U1 to become reset in the event of a power failure. The power supply 140 also delivers a 5 volt source and a 10.5 volts source to the electronics of the bingo player 10.

Card display decode circuit 80 is typically composed of BCD to decimal decoders U17 through U19. Card display column driver circuit 90 typically is composed of five 74HC174 Hex "D" flip-flops U25 through U29. Card display row driver circuit 110 is typically composed of three 4028 BCD to Decimal decoders.

Barcode sensor interface circuit 120 is typically composed of five 74HC244 tri-state octal line drivers U20 through U24 and associated components. Option switch interface circuit 130 is typically composed of a single 74HC244 tri-state octal line driver U13 and associated components. Row decode circuit 100 is typically composed of a single 74HC174 Hex "D" flip-flop U16. Barcode enable decode circuit 70 is typically composed of two 74HC138 3 to 8 line decoder/demultiplexers U3 and U4. Keypad/display interface circuit 60 is typically composed of a single 8279 programmable keyboard/display interface U14. Serial interface circuit 150 is typically composed of a 4040 12 stage binary/ripple counter U12, a 8251 BCD to decimal decoder U11 and associated components. The serial interface circuit 150 offers a bidirectional serial communications link to allow any bingo player 10 to be either a master 10 or slave (15–18 of FIG. 1*b*) bingo player.

Operator panel circuit 50 is composed of a 4028 BCD to decimal decoder U31, displays drivers U30 (ULN2803) and U32 (ULN2982), 74HC74 dual "D" flip-flop U33, speaker 53, new game switch 52, keyboard 12, display 13 and associated components. The operator panel circuit 50 provides key inputs of digits 0 to 9, a clear entry switch, an "enter" switch, a "BINGO" switch (within keyboard 12) and the new game switch 52. The player can input the called number via the digit switches and can clear an improper entry with the clear entry switch on keyboard 12. Once the player is sure that he has punched in the proper called number (which is simultaneously displayed on display 13), the player presses the "enter" switch and the called number is entered in the main processor 20 memory as a called number. If the player sees that one or more bingo cards have won a game, he may punch the "BINGO" switch and a light 22 (only seen in FIG. 1*a*) will light showing other players that there is a winning bingo card in existence. Once a game of bingo is finished, the player must push the new game switch 52 to clear the called numbers from the main processor 20 memory. Each keypress on keyboard 12 can be made to make an audible "beep" via the main processor 20, the 74HC74 dual "D" flip-flop U33, speaker 53 and associated components.

The card display panel circuit 40 is composed of ten BC sensor assemblies 42. A typical circuit for each of the BC sensor assemblies 42 is shown in FIG. 3*i* and is composed of two TIL 158 opto-coupled interrupter modules which sense the barcodes 42 and 44 from each of the dual bingo cards 11 and send this information to one of two LM393 voltage comparators which, in turn, send their signals over their A and B lines. The card display panel circuit 40 is also composed of twenty $5\times5$ matrix LED's 14, each of which typically consist of the lamp driver circuit shown in FIG. 3*j*. The column driver consists of a 2N2222 and a TIP 32A transistor and associated components. The row driver typically consists of a 15N05 FET. The row driver and column driver drive dual LED's for each of the $5\times5$ matrix LED's 14.

All of the values of resistors shown in FIGS. 3*b* through 3*j* are in kiloohms unless otherwise specified. All of the values of capacitors shown in FIGS. 3*b* through 3*j* are in microfarads unless otherwise specified.

BASIC OPERATION OF BINGO PLAYER

Figure 5A:
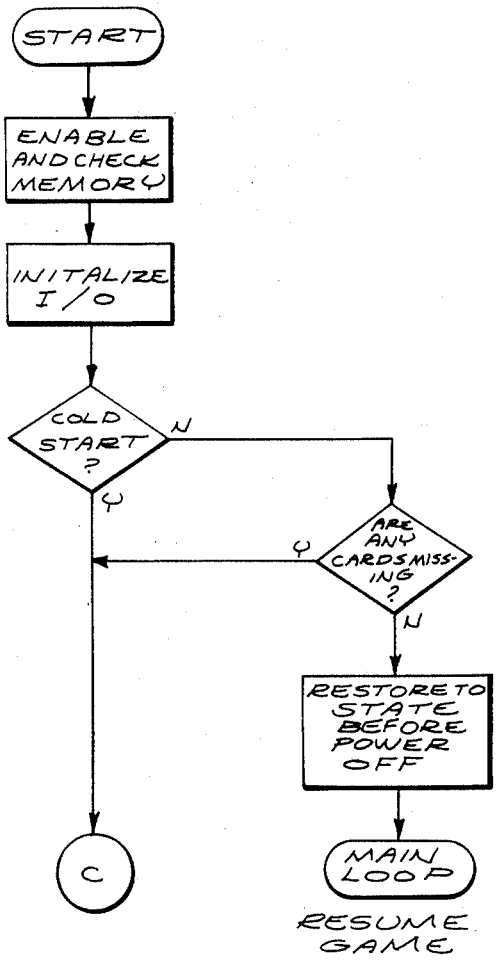
Figure 5B:
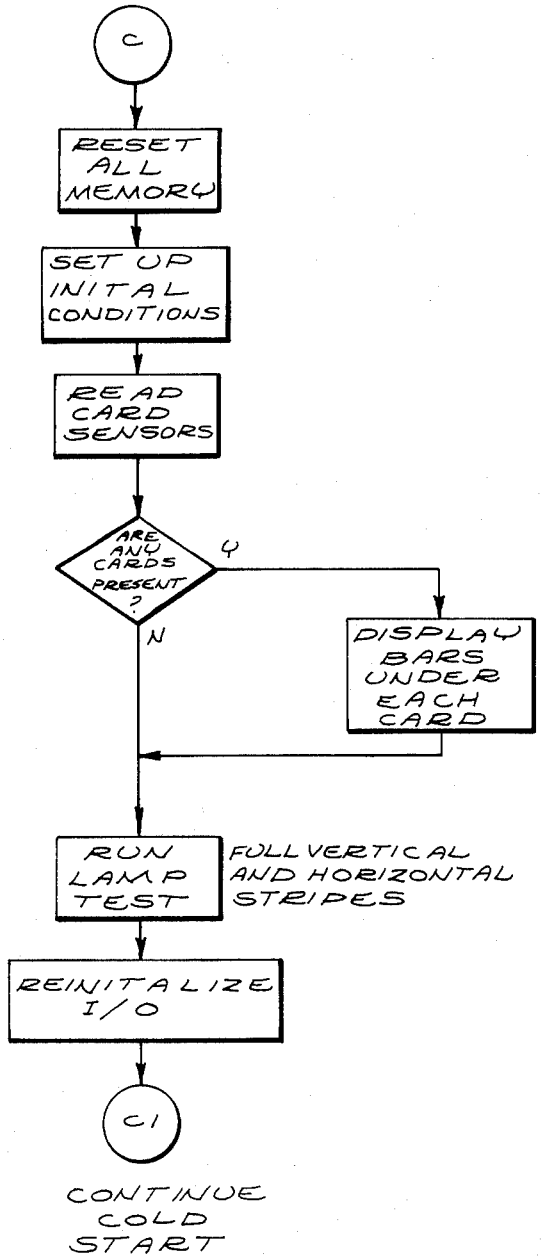
Figure 5C:
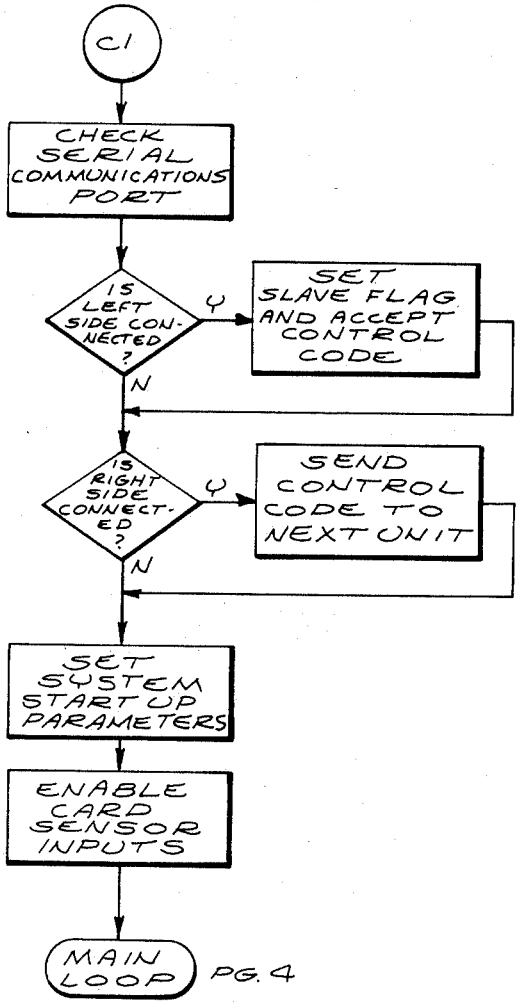
Figure 5E:
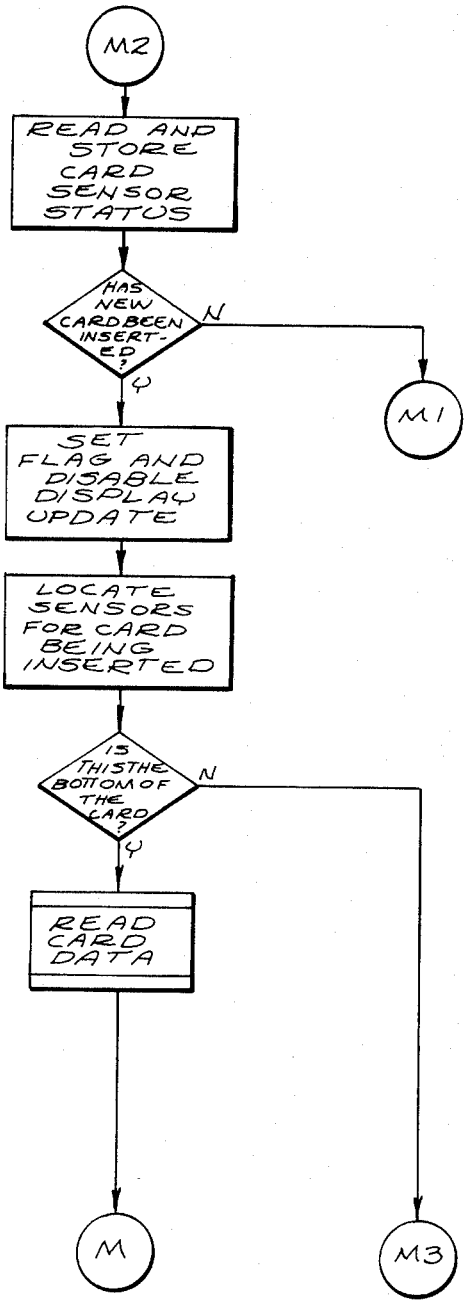
Figure 5D:
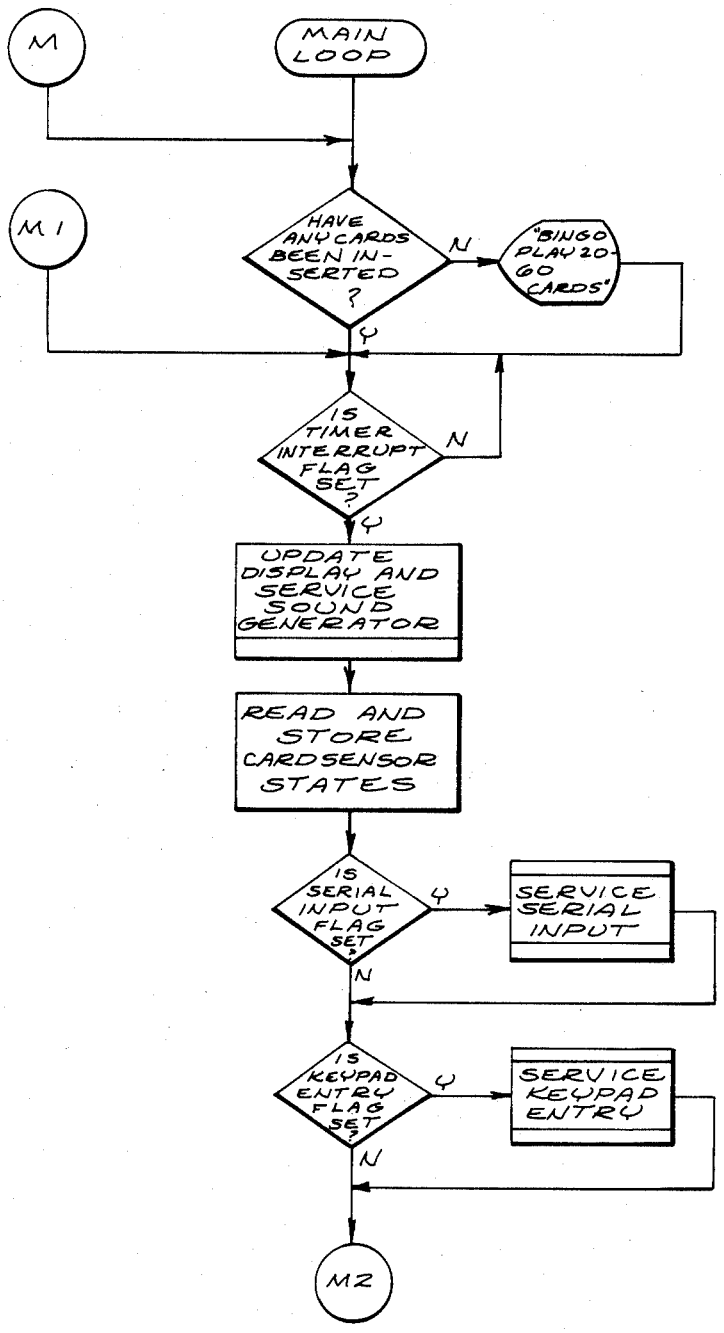
Figure 5F:
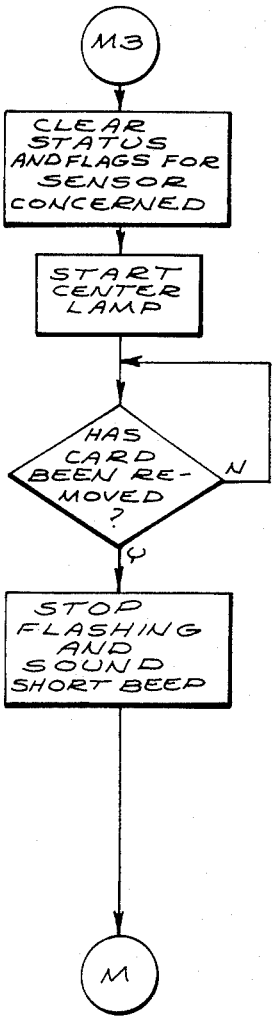
Figure 5G:
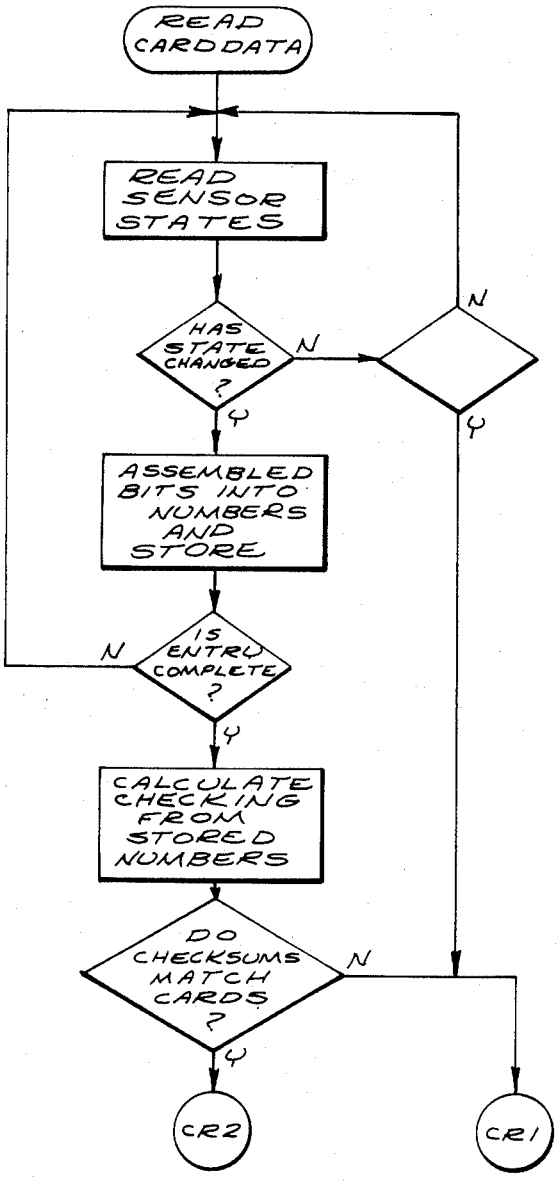
Figure 5H:
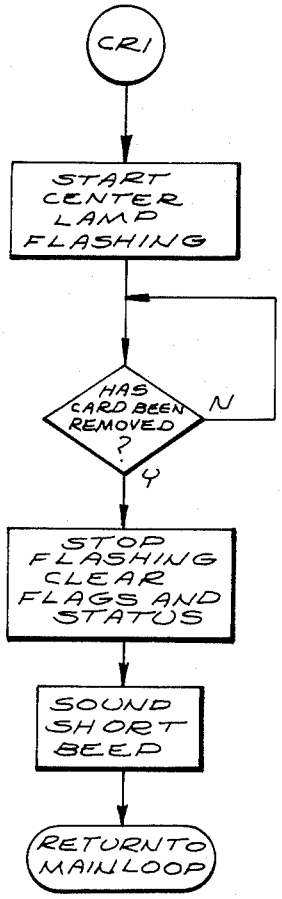
Figure 5I:
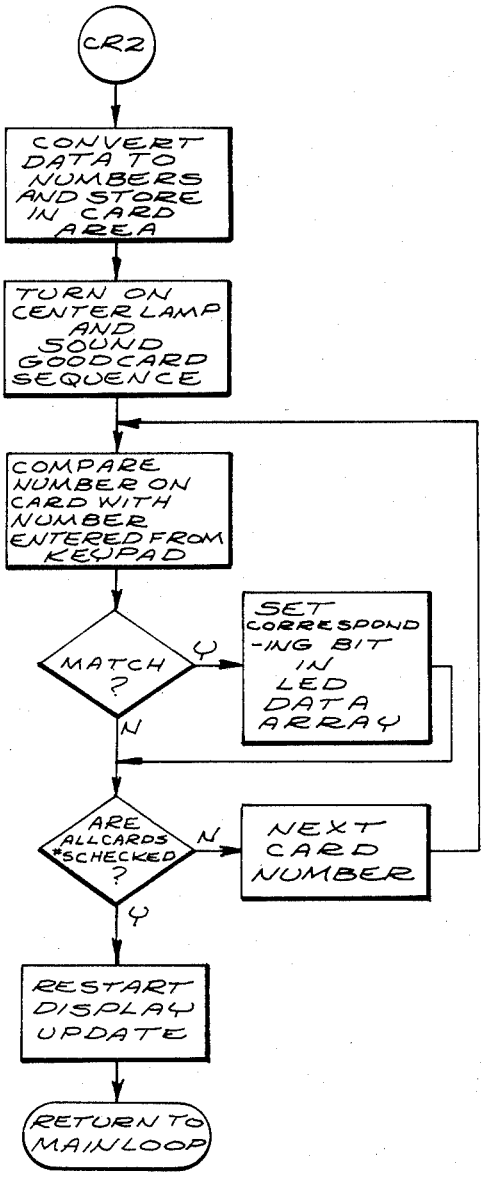
Figure 5J:
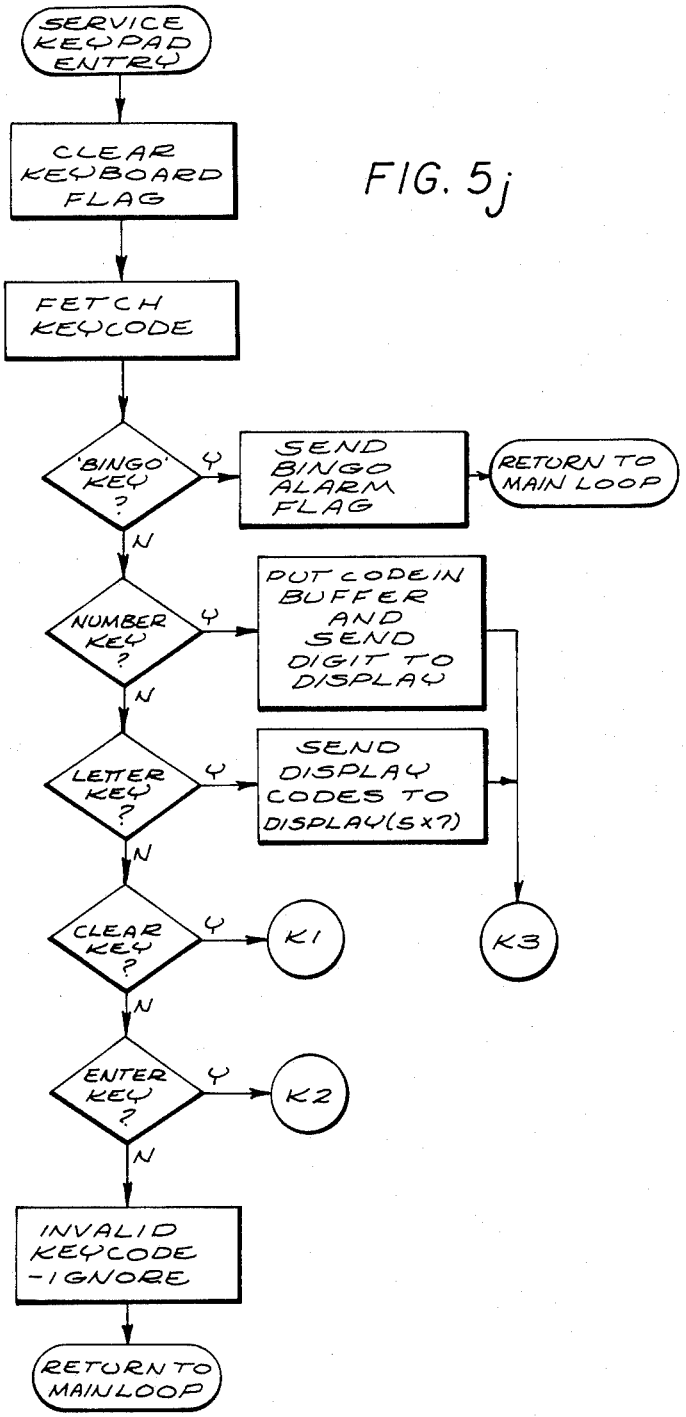
Figure 5K:
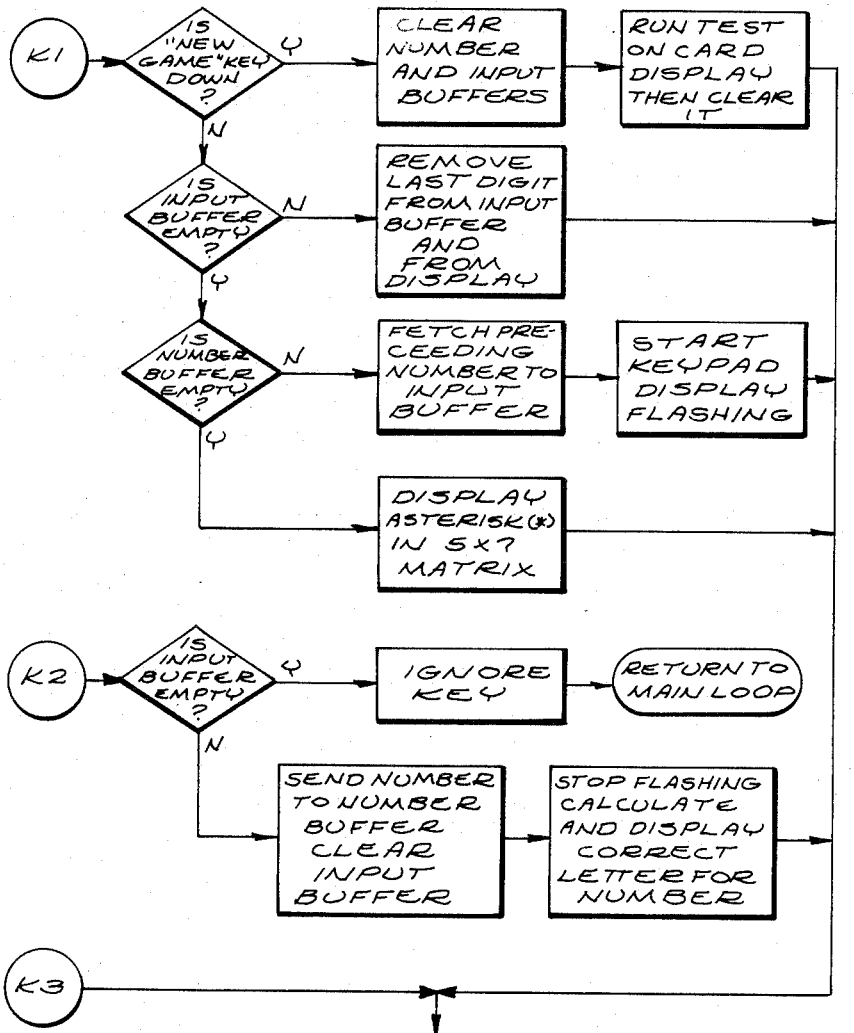
Figure 5L:
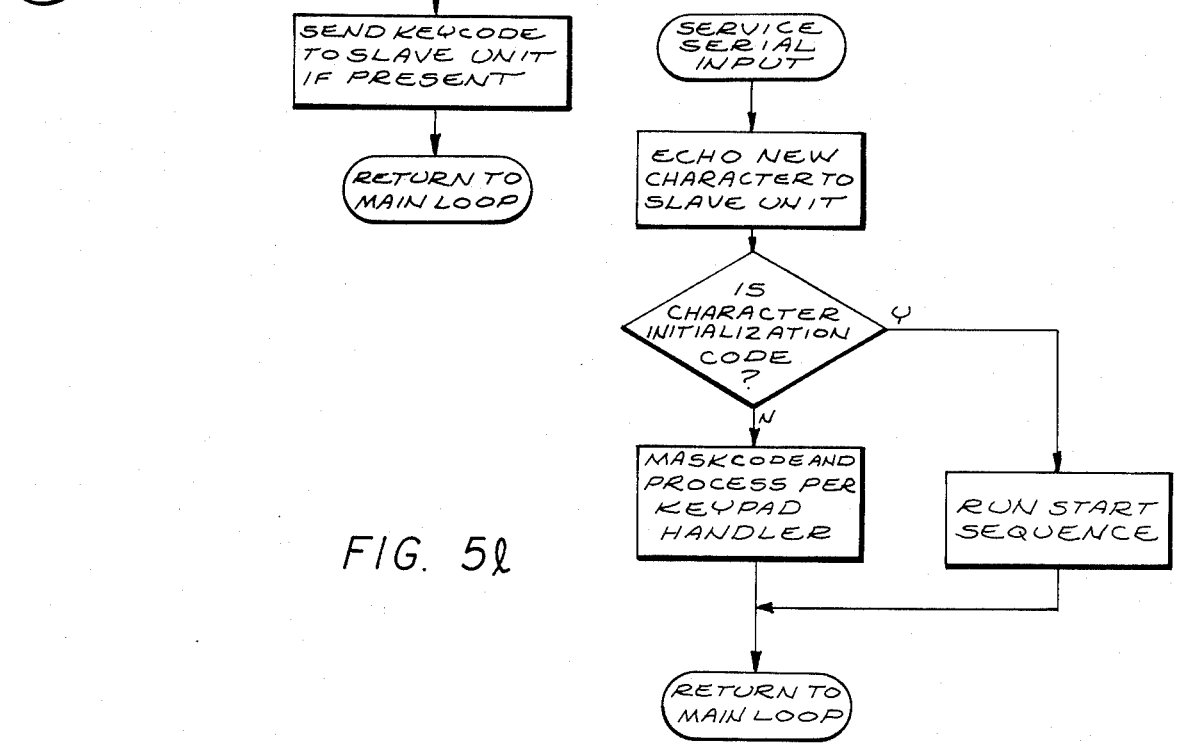
Figure 5M:
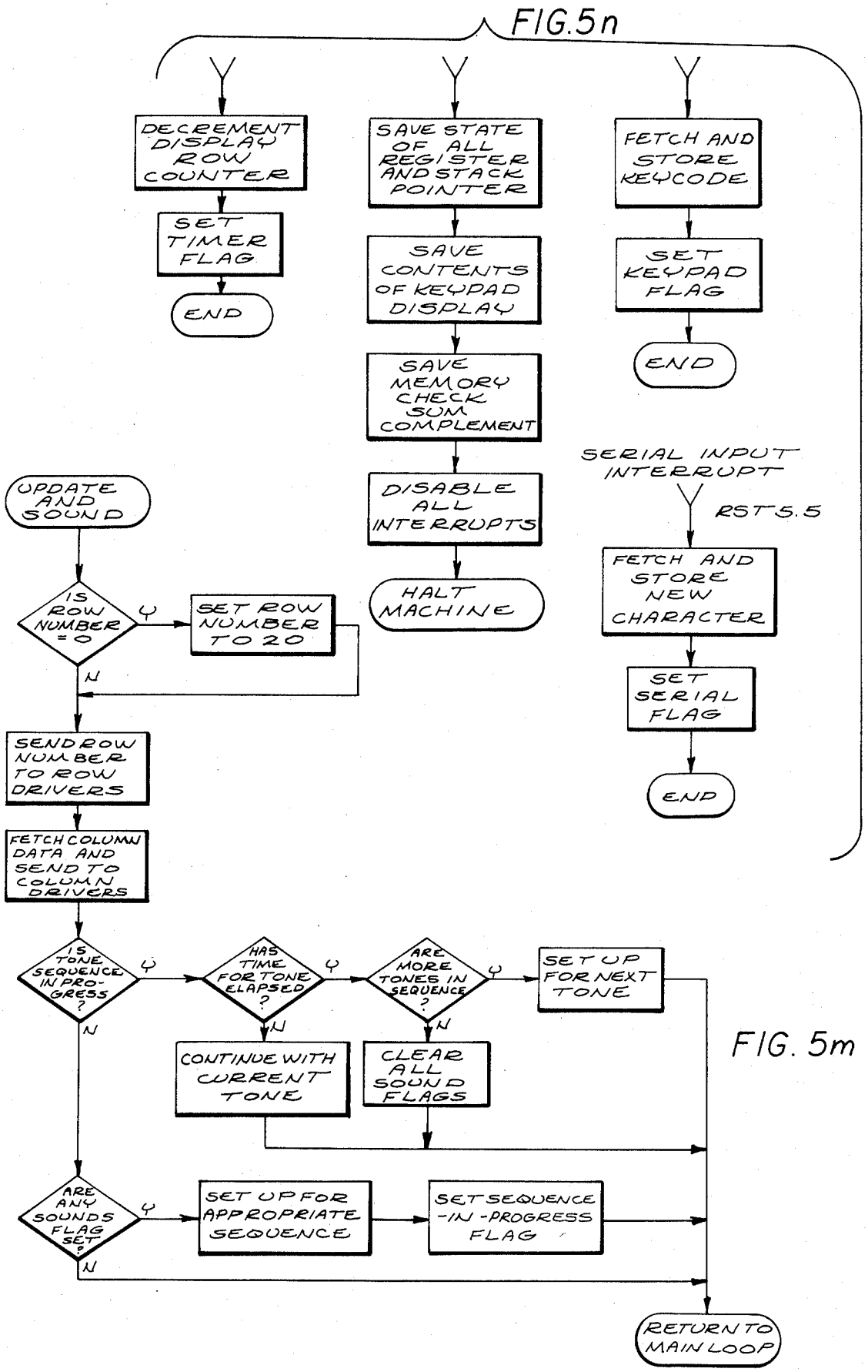

Referring to FIGS. 5*a* through 5*c*, the flow diagrams for the basic logic of the programming for the main processor 20 (FIG. 3*b*) is shown. Referring specifically to FIG. 5*a*, the basic start-up sequence is shown. If the bingo player 10 has just been turned on, then the main processor 20 is put through a cold start sequence basically described in FIGS. 5*b* and 5*c*. If the bingo player 10 has begun a new game, then the logic puts the main processor 20 into its main loop operation shown more particularly in FIGS. 5*d* through 5*f*. The card data input routine, keypad entry routine and serial number handler routines which are inputs to the main loop operation are basically described in FIGS. 5*g* through 5*m*.

Of particular note but only generally described in the flow diagrams of FIGS. 5*a* through 5*n* is the process of verification of the correctness of the 24 numbers inputted from each bingo card. This process begins by adding together all of the 24 numbers actually read by the bingo player 10 and creating a check sum. The verification number (also read from each bingo card) is set so that if the main processor 20 has the proper check sum, the subtracting of the verification number and the check sum will equal zero. If the difference is other than zero, the card data entry routine will start the LED under the free space of the affected bingo card to begin to flash until the player removes the card. If the difference is zero, then the LED in the free space is turned on continuously.

Also of note but not specifically described in the flow diagrams of FIGS. 5*a* through 5*n* is the process of indicating that an inputted called number had already been inputted by the player during a particular bingo game. This process is begun by having in permanent memory an array of all possible numbers between 1 and 75, inclusive. Next, each inputted called number in memory is checked off this array of all possible bingo numbers. If the main processor 20 is given the same called number twice in the same game, it will indicate an error condition in display 13 and refuse to accept this same called number a second time. Thus, an obviously erroneous called number is prevented from being added to memory.

Referring specifically to FIG. 5*n*, shown therein are the basic flow charts for the four interrupts of the preferred embodiment of the bingo player 10, namely (1) the timer interrupt, (2) power failure interrupt, (3) keypad interrupt, and (4) serial input interrupt.

Attached hereto as an appendix is a listing of the progamming for the preferred embodiment of the bingo player 10, which appendix consists of 64 pages.

The above described preferred embodiment of the present invention is merely descriptive of its principles and is not to be considered limiting. The scope of the present invention shall instead be determined from the scope of the following claims and their equivalents.

APPENDIX

PROGRAM LISTING FOR THE AUTOMATIC BINGO PLAYING MACHINE EMPLOYING AN 8085 MICROPROCESSOR

```
203C  JMP  13F3  - RST 7.5 Clock
203F  NOP
2040  CALL 1469  - initialize 8251 & 8279
2043  CALL 14AD  - clear memory
2046  MVI  A,FF  - reset display row drivers
2048  STA  A805
204B  MVI  A,60  - set up 8279
204D  STA  9001
2050  MVI  A,80
2052  STA  9001
2055  MVI  B,00
2057  MOV  A,B
2058  STA  9000  - clear keyboard display memory
205B  LDA  9000    (The hard way)
205E  MOV  A,B
205F  STA  9800
2062  STA  9801
2065  STA  A000  - also send to AUX
2068  STA  A806  - and to 5533
206B  INR  B     - for 100H loops
206C  JNZ  0057
206F  MVI  B,00
2071  LXI  D,01E4
2074  MVI  A,FF
2076  STA  A805  - reset row drivers again
2079  LXI  H,A800 - clear all column drivers
207C  MVI  C,05
```

```
207E  LDAX D
207F  MOV  M,A
2080  INX  H
2081  NOP
2082  DCR  C
2083  JNZ  007E
2086  MOV  A,B
2087  CPI  08
2089  JC   0096
208C  CPI  10
208E  JC   009B
2091  ORI  18
2093  JMP  009D
2096  ORI  30
2098  JMP  009D
209B  ORI  28
209D  STA  A805
20A0  INR  B
20A1  MOV  A,B
20A2  CPI  14
20A4  JZ   006F
20A7  INX  D
20A8  MOV  A,E
20A9  CPI  E9
20AB  JZ   0071
20AE  JMP  0074
20B1  DI
20B2  ??=  20  RIM
20B3  ORA  A
20B4  JP   00C4
20B7  IN   80
20B9  RAR
20BA  NOP
20BB  ANI  60
20BD  MOV  B,A
20BE  XRA  C
20BF  MOV  C,B
20C0  MOV  L,A
20C1  MVI  H,01
20C3  PCHL
20C4  IN   80
20C6  RAL
20C7  ANI  60
20C9  MOV  B,A
20CA  XRA  C
20CB  MOV  C,B
20CC  MOV  L,A
20CD  MVI  H,01
20CF  PCHL
20D0  NOP
20D1  NOP
20D2  NOP
20D3  NOP
20D4  NOP
20D5  NOP
20D6  NOP
20D7  NOP
20D8  NOP
20D9  NOP
20DA  NOP
20DB  NOP
20DC  NOP
20DD  NOP
20DE  NOP
20DF  NOP
20E0  NOP
20E1  NOP
20E2  NOP
20E3  NOP
20E4  NOP
20E5  NOP
20E6  NOP
20E7  NOP
20E8  NOP
20E9  NOP
20EA  NOP
20EB  NOP
20EC  NOP
20ED  NOP
20EE  NOP
20EF  NOP
20F0  NOP
20F1  NOP
20F2  NOP
20F3  NOP
20F4  NOP
20F5  NOP
20F6  NOP
20F7  NOP
20F8  NOP
20F9  NOP
20FA  NOP
20FB  NOP
20FC  NOP
20FD  NOP
20FE  NOP
20FF  NOP
2100  INR  D
2101  INR  E
2102  JZ   0116
2105  LXI  H,88FA
2108  MVI  A,D8
210A  CMP  M
210B  JC   0116
210E  LXI  H,88FC
2111  CMP  M
2112  JNC  00B2
2115  XRA  A
2116  EI
2117  RET
2118  NOP
2119  NOP
211A  NOP
211B  NOP
```

```
211C  NOP
211D  NOP
211E  NOP
211F  NOP
2120  LHLD 88FA
2123  MOV  M,E
2124  INX  H
2125  SHLD 88FA
2128  MVI  E,01
212A  INR  D
212B  MOV  A,M
212C  JMP  00B2
212F  NOP
2130  NOP
2131  NOP
2132  NOP
2133  NOP
2134  NOP
2135  NOP
2136  NOP
2137  NOP
2138  NOP
2139  NOP
213A  NOP
213B  NOP
213C  NOP
213D  NOP
213E  NOP
213F  NOP
2140  LHLD 88FC
2143  MOV  M,D
2144  INX  H
2145  SHLD 88FC
2148  MVI  D,01
214A  INR  E
214B  MOV  A,M
214C  JMP  00B2
214F  NOP
2150  NOP
2151  NOP
2152  NOP
2153  NOP
2154  NOP
2155  NOP
2156  NOP
2157  NOP
2158  NOP
2159  NOP
215A  NOP
215B  NOP
215C  NOP
215D  NOP
215E  NOP
215F  NOP
2160  LHLD 88FA
2163  MOV  M,E
2164  INX  H
2165  SHLD 88FA
2168  LHLD 88FC
216B  MOV  M,D
216C  INX  H
216D  SHLD 88FC
2170  LXI  D,0202
2173  XTHL
2174  XTHL
2175  XTHL
2176  XTHL
2177  XTHL
2178  XTHL
2179  NOP
217A  NOP
217B  JMP  00B2
217E  NOP
217F  NOP
2180  RRC
2181  RAR
2182  LXI  D,0E0E
2185  LXI  D,1304
2188  LXI  B,0F11
218B  INR  B
218C  DCR  D
218D  DCR  E
218E  LXI  D,0411
2191  DAD  D
2192  LXI  D,0F11
2195  RAR
2196  LXI  D,0E0E
2199  RRC
219A  LXI  B,1104
219D  NOP
219E  LXI  D,0A01
21A1  LDAX B
21A2  NOP
21A3  RRC
21A4  LXI  B,0411
21A7  NOP
21A8  LXI  B,1F01
21AB  INR  B
21AC  NOP
21AD  LXI  B,111F
21B0  INR  B
21B1  NOP
21B2  MVI  C,0E
21B4  NOP
21B5  MVI  C,0E
21B7  LXI  D,0011
21BA  LXI  B,1011
21BD  LXI  D,0F1F
21C0  LXI  D,110E
21C3  NOP
21C4  LXI  D,1F11
21C7  MVI  C,00
21C9  MVI  C,0E
21CB  MVI  E,04
```

```
21CD  RRC
21CE  RRC
21CF  MVI  E,01
21D1  LDAX B
21D2  LXI  D,0111
21D5  LXI  B,0F11
21D8  LXI  D,010E
21DB  RAR
21DC  DAD  B
21DD  LXI  D,1E10
21E0  LXI  D,0F11
21E3  RRC
21E4  LXI  D,040A
21E7  LDAX B
21E8  LXI  D,0000
21EB  NOP
21EC  NOP
21ED  NOP
21EE  NOP
21EF  NOP
21F0  NOP
21F1  NOP
21F2  NOP
21F3  NOP
21F4  NOP
21F5  NOP
21F6  NOP
21F7  NOP
21F8  NOP
21F9  NOP
21FA  NOP
21FB  NOP
21FC  NOP
21FD  NOP
21FE  NOP
21FF  NOP
2200  CMC        3F- ?  ??
2201  MVI  B,5B  06, 5B  [
2203  MOV  C,A   4F .  O
2204  MOV  H,M   6E     n
2205  MOV  L,L   6D     m
2206  MOV  A,L   7D     }
2207  RLC        07
2208  MOV  A,A   7F
2209  MOV  H,A   67     w
220A  MOV  A,A   7F     ⅄
220B  MOV  C,C   49     I
220C  MOV  C,C   49     I
220D  MOV  C,C   49     I
220E  MVI  M,00  36, 00  6
2210  MOV  B,C   41     A
2211  MOV  A,A   7F
2212  MOV  B,C   41     A
2213  NOP        00
2214  MOV  A,A   7F
2215  ??=  20    20     ⅋
2216  ??=  10    1Ø
```

ASCII DATA or bit patterns

```
2217  ??=  08      08
2218  MOV  A,A     7F
2219  MVI  A,41    3E ,41  > A
221B  MOV  C,C     49   I
221C  MOV  C,C     49   I
221D  MVI  L,3E    2E, 3E  .>
221F  MOV  B,C     41   A
2220  MOV  B,C     41   A
2221  MOV  B,C     41   A
2222  MVI  A,00    3E,Ø
2224  NOP
2225  NOP
2226  NOP
2227  NOP
2228  SHLD 7F14
222B  INR  D
222C  SHLD 497F
222F  MOV  C,C
2230  MOV  C,C
2231  MOV  B,C
2232  LXI  H,88B2
2235  MOV  M,C
2236  LDA  9801
2239  ANI  01    Transmit interrupt
223B  CPI  00
223D  JNZ  0243  Y
2240  JMP  0236  No-wait
2243  LDA  88B2
2246  ANI  FF
2248  STA  9800  Send character
224B  RET
224C  LDA  9801
224F  ANI  02
2251  CPI  00
2253  JNZ  0259
2256  JMP  024C
2259  LDA  9800
225C  ANI  7F
225E  RET
225F  LXI  H,88B4
2262  MOV  M,B
2263  DCX  H
2264  MOV  M,C
2265  MVI  A,00
2267  LXI  H,88B3
226A  CALL 1388
226D  JNC  0276
2270  LHLD 88B3
2273  SHLD 88AF
2276  LXI  B,FFF0
2279  LXI  D,88AF
227C  CALL 1375
227F  JNC  0285
2282  JMP  0276
2285  RET
2286  LXI  H,9001
22B9  MVI  M,90
22BB  LXI  H,88B5
22BE  MVI  M,00
2290  MVI  A,06
2292  LXI  H,88B5
2295  CMP  M
2296  JC   02A5
2299  LXI  H,9000
229C  MVI  M,00
229E  LXI  H,88B5
22A1  INR  M
22A2  JNZ  0290
22A5  LXI  H,889A
22A8  MVI  M,00
22AA  DCX  H
22AB  MVI  M,00
22AD  RET
22AE  LXI  H,88B6
22B1  MVI  M,00
22B3  MVI  A,4A
22B5  LXI  H,88B6
22B8  CMP  M
22B9  JC   02CE
22BC  LHLD 88B6
22BF  MVI  H,00
22C1  LXI  B,8200
22C4  DAD  B
22C5  MVI  M,00
22C7  LXI  H,88B6
22CA  INR  M
22CB  JNZ  02B3
22CE  LXI  H,88A0
22D1  MVI  M,00
22D3  RET
22D4  LXI  H,88B7
22D7  MVI  M,00
22D9  MVI  A,4A
22DB  LXI  H,88B7
22DE  CMP  M
22DF  JC   0317
22E2  LXI  H,88B8
22E5  MVI  M,00
22E7  MVI  A,13
22E9  LXI  H,88B8
22EC  CMP  M
22ED  JC   0310
22F0  LXI  D,0014
22F3  LHLD 88B7
22F6  MVI  H,00
22F8  CALL 1342
22FB  LXI  B,8257
22FE  DAD  B
22FF  PUSH H
2300  LHLD 88B8
2303  MVI  H,00
2305  POP  B
```

```
2306  DAD  B
2307  MVI  M,00
2309  LXI  H,88B8
230C  INR  M
230D  JNZ  02E7
2310  LXI  H,88B7
2313  INR  M
2314  JNZ  02D9
2317  RET
2318  LXI  H,88B9
231B  MVI  M,00
231D  MVI  A,13
231F  LXI  H,88B9
2322  CMP  M
2323  JC   035B
2326  LXI  H,88BA
2329  MVI  M,00
232B  MVI  A,04
232D  LXI  H,88BA
2330  CMP  M
2331  JC   0354
2334  LXI  D,0005
2337  LHLD 88B9
233A  MVI  H,00
233C  CALL 1342
233F  LXI  B,8833
2342  DAD  B
2343  PUSH H
2344  LHLD 88BA
2347  MVI  H,00
2349  POP  B
234A  DAD  B
234B  MVI  M,00
234D  LXI  H,88BA
2350  INR  M
2351  JNZ  032B
2354  LXI  H,88B9
2357  INR  M
2358  JNZ  031D
235B  RET
235C  LXI  H,88A5
235F  MVI  M,FF
2361  LXI  H,0000
2364  SHLD 88AF
2367  RET
2368  LXI  H,88A5
236B  MVI  M,00
236D  LXI  H,9001
2370  MVI  M,A0
2372  RET
2373  LXI  H,88BB
2376  MOV  M,C
2377  LXI  H,9001
237A  MVI  M,95
237C  LHLD 88BB
237F  MVI  H,00
2381  XCHG
2382  LXI  H,000A
2385  CALL 1318
2388  LXI  H,8899
238B  MOV  M,E
238C  LHLD 88BB
238F  MVI  H,00
2391  XCHG
2392  CALL 131A
2395  XCHG
2396  LXI  H,889A
2399  MOV  M,E
239A  DCX  H
239B  MOV  A,M
239C  CPI  00
239E  JNZ  03A9
23A1  LXI  H,9000
23A4  MVI  M,00
23A6  JMP  03B6
23A9  LHLD 8899
23AC  MVI  H,00
23AE  LXI  B,0200
23B1  DAD  B
23B2  MOV  A,M
23B3  STA  9000
23B6  LDA  889A
23B9  SUI  00
23BB  SUI  01
23BD  SBB  A
23BE  PUSH PSW
23BF  LDA  8899
23C2  SUI  00
23C4  SUI  01
23C6  SBB  A
23C7  POP  B
23C8  MOV  C,B
23C9  ANA  C
23CA  RAR
23CB  JNC  03D6
23CE  LXI  H,9000
23D1  MVI  M,00
23D3  JMP  03E3
23D6  LHLD 889A
23D9  MVI  H,00
23DB  LXI  B,0200
23DE  DAD  B
23DF  MOV  A,M
23E0  STA  9000
23E3  RET
23E4  LXI  H,88BC
23E7  MOV  M,C
23E8  LXI  H,9001
23EB  MVI  M,90
23ED  LXI  H,88BD
23F0  MVI  M,00
23F2  MVI  A,04
```

```
23F4  LXI  H,88BD
23F7  CMP  M
23F8  JC   041D
23FB  LXI  D,0005
23FE  LHLD 88BC
2401  MVI  H,00
2403  CALL 1342
2406  LXI  B,020A
2409  DAD  B
240A  PUSH H
240B  LHLD 88BD
240E  MVI  H,00
2410  POP  B
2411  DAD  B
2412  MOV  A,M
2413  STA  9000
2416  LXI  H,88BD
2419  INR  M
241A  JNZ  03F2
241D  RET
241E  LXI  H,88BE
2421  MOV  M,C
2422  LHLD 88A0
2425  MVI  H,00
2427  LXI  B,8200
242A  DAD  B
242B  LDA  88BE
242E  MOV  M,A
242F  LXI  H,88A0
2432  INR  M
2433  MVI  A,4B
2435  CMP  M
2436  JNC  043E
2439  LXI  H,88A0
243C  MVI  M,4A
243E  RET
243F  LXI  H,88A0
2442  DCR  M
2443  MOV  A,M
2444  CPI  FF
2446  JNZ  044E
2449  LXI  H,88A0
244C  MVI  M,00
244E  LHLD 88A0
2451  MVI  H,00
2453  LXI  B,8200
2456  DAD  B
2457  MOV  A,M
2458  STA  88BF
245B  LHLD 88A0
245E  MVI  H,00
2460  DAD  B
2461  MVI  M,00
2463  MVI  C,00
2465  NOP
2466  NOP
2467  CALL 0373
246A  LDA  88BF
246D  DCR  A
246E  MOV  E,A
246F  MVI  D,00
2471  LXI  H,000F
2474  CALL 1318
2477  MOV  C,E
2478  CALL 03E4
247B  LXI  H,88A3
247E  MVI  M,FF
2480  INX  H
2481  MVI  M,FF
2483  LDA  88BF
2486  RET
2487  LXI  H,88C2
248A  MOV  M,D
248B  DCX  H
248C  MOV  M,E
248D  DCX  H
248E  MOV  M,C
248F  LXI  H,88C4
2492  MVI  M,00
2494  MVI  A,18
2496  LXI  H,88C4
2499  CMP  M
249A  JC   04E2
249D  LHLD 88C4
24A0  MVI  H,00
24A2  XCHG
24A3  LHLD 88C1
24A6  DAD  D
24A7  MOV  A,M
24A8  DCR  A
24A9  STA  88C3
24AC  LDA  88C4
24AF  CPI  0C
24B1  JZ   04DB
24B4  LHLD 88C4
24B7  MVI  H,00
24B9  XCHG
24BA  LXI  H,0005
24BD  CALL 1318
24C0  INX  H
24C1  LXI  D,0014
24C4  PUSH H
24C5  LHLD 88C3
24C8  MVI  H,00
24CA  CALL 1342
24CD  LXI  B,8257
24D0  DAD  B
24D1  PUSH H
24D2  LHLD 88C0
24D5  MVI  H,00
24D7  POP  B
24D8  DAD  B
24D9  POP  B
24DA  MOV  M,C
```

```
24DB  LXI  H,88C4
24DE  INR  M
24DF  JNZ  0494
24E2  RET
24E3  LXI  H,88C6
24E6  MOV  M,E
24E7  DCX  H
24E8  MOV  M,C
24E9  LXI  H,88C7
24EC  MVI  M,00
24EE  MVI  A,13
24F0  LXI  H,88C7
24F3  CMP  M
24F4  JC   05C5
24F7  LXI  D,0014
24FA  LHLD 88C5
24FD  MVI  H,00
24FF  CALL 1342
2502  LXI  B,8257
2505  DAD  B
2506  PUSH H
2507  LHLD 88C7
250A  MVI  H,00
250C  POP  B
250D  DAD  B
250E  MOV  A,M
250F  STA  88C9
2512  MOV  C,A
2513  MVI  A,00
2515  CMP  C
2516  JNC  05BE
2519  LHLD 88C7
251C  MVI  H,00
251E  XCHG
251F  LXI  H,0004
2522  CALL 1318
2525  LXI  D,0005
2528  CALL 1342
252B  LDA  88C9
252E  DCR  A
252F  MOV  E,A
2530  MVI  D,00
2532  DAD  D
2533  XCHG
2534  LXI  H,88CB
2537  MOV  M,E
2538  LHLD 88C7
253B  MVI  H,00
253D  XCHG
253E  LXI  H,0004
2541  CALL 1318
2544  LXI  H,88CC
2547  MOV  M.E
2548  LHLD 88C5
254B  MVI  H,00
254D  XCHG
254E  LXI  H,000F
2551  CALL 1318
2554  LXI  H,88C8
2557  MOV  M,E
2558  LXI  H,88CD
255B  MVI  M,01
255D  LXI  H,88CA
2560  MVI  M,01
2562  LDA  88C8
2565  LXI  H,88CA
2568  CMP  M
2569  JC   057A
256C  LDA  88CD
256F  ADD  A
2570  STA  88CD
2573  LXI  H,88CA
2576  INR  M
2577  JNZ  0562
257A  LDA  88C6
257D  CPI  00
257F  JNZ  05A1
2582  LXI  D,0005
2585  LHLD 88CB
2588  MVI  H,00
258A  CALL 1342
258D  LXI  B,8833
2590  DAD  B
2591  PUSH H
2592  LHLD 88CC
2595  MVI  H,00
2597  POP  B
2598  DAD  B
2599  LDA  88CD
259C  ORA  M
259D  MOV  M,A
259E  JMP  05BE
25A1  LXI  D,0005
25A4  LHLD 88CB
25A7  MVI  H,00
25A9  CALL 1342
25AC  LXI  B,8833
25AF  DAD  B
25B0  PUSH H
25B1  LHLD 88CC
25B4  MVI  H,00
25B6  POP  B
25B7  DAD  B
25B8  LDA  88CD
25BB  CMA
25BC  ANA  M
25BD  MOV  M,A
25BE  LXI  H,88C7
25C1  INR  M
25C2  JNZ  04EE
25C5  RET
25C6  LXI  H,88CF
```

```
25C9  MOV  M,E
25CA  DCX  H
25CB  MOV  M,C
25CC  LHLD 88CE
25CF  MVI  H,00
25D1  XCHG
25D2  LXI  H,0002
25D5  CALL 1318
25D8  CALL 133B
25DB  INX  H
25DC  INX  H
25DD  XCHG
25DE  LXI  H,88D2
25E1  MOV  M,E
25E2  LHLD 88CE
25E5  MVI  H,00
25E7  XCHG
25E8  LXI  H,0002
25EB  CALL 1318
25EE  LXI  H,88D3
25F1  MOV  M,E
25F2  LXI  H,88D0
25F5  MVI  M,00
25F7  MVI  A,01
25F9  LXI  H,88D0
25FC  CMP  M
25FD  JC   0675
2600  LXI  D,0005
2603  LHLD 88D2
2606  MVI  H,00
2608  CALL 1342
260B  LXI  B,8833
260E  DAD  B
260F  PUSH H
2610  LHLD 88D3
2613  MVI  H,00
2615  POP  B
2616  DAD  B
2617  MOV  A,M
2618  STA  88D1
261B  LDA  88CF
261E  CPI  FF
2620  JNZ  0646
2623  LDA  88D1
2626  ORI  04
2628  LXI  D,0005
262B  LHLD 88D2
262E  MVI  H,00
2630  PUSH PSW
2631  CALL 1342
2634  LXI  B,8833
2637  DAD  B
2638  PUSH H
2639  LHLD 88D3
263C  MVI  H,00
263E  POP  B
263F  DAD  B
2640  POP  B
2641  MOV  C,B
2642  MOV  M,C
2643  JMP  0666
2646  LDA  88D1
2649  ANI  FB
264B  LXI  D,0005
264E  LHLD 88D2
2651  MVI  H,00
2653  PUSH PSW
2654  CALL 1342
2657  LXI  B,8833
265A  DAD  B
265B  PUSH H
265C  LHLD 88D3
265F  MVI  H,00
2661  POP  B
2662  DAD  B
2663  POP  B
2664  MOV  C,B
2665  MOV  M,C
2666  LDA  88D2
2669  ADI  05
266B  STA  88D2
266E  LXI  H,88D0
2671  INR  M
2672  JNZ  05F7
2675  RET
2676  LHLD 88AB
2679  MVI  H,00
267B  XCHG
267C  LXI  H,0002
267F  CALL 1318
2682  LXI  H,88D5
2685  MOV  M,E
2686  DCX  H
2687  MVI  M,00
2689  MVI  A,09
268B  LXI  H,88D4
268E  CMP  M
268F  JC   06C4
2692  LHLD 88AB
2695  MVI  H,00
2697  XCHG
2698  LXI  H,0002
269B  CALL 1318
269E  CALL 133B
26A1  PUSH H
26A2  LHLD 88D4
26A5  MVI  H,00
26A7  POP  B
26A8  DAD  B
26A9  LXI  D,0005
26AC  CALL 1342
26AF  LXI  B,8833
```

```
26B2  DAD  B
26B3  PUSH H
26B4  LHLD 88D5
26B7  MVI  H,00
26B9  POP  B
26BA  DAD  B
26BB  MVI  M,00
26BD  LXI  H,88D4
26C0  INR  M
26C1  JNZ  0689
26C4  RET
26C5  LXI  H,88D6
26C8  MOV  M,C
26C9  LHLD 88D6
26CC  MVI  H,00
26CE  DAD  H
26CF  XCHG
26D0  LXI  H,88D7
26D3  MOV  M,E
26D4  INX  H
26D5  MVI  M,00
26D7  MVI  A,4A
26D9  LXI  H,88D8
26DC  CMP  M
26DD  JC   071D
26E0  LXI  D,0014
26E3  LHLD 88D8
26E6  MVI  H,00
26E8  CALL 1342
26EB  LXI  B,8257
26EE  DAD  B
26EF  PUSH H
26F0  LHLD 88D7
26F3  MVI  H,00
26F5  POP  B
26F6  DAD  B
26F7  MVI  M,00
26F9  LXI  D,0014
26FC  LHLD 88D8
26FF  MVI  H,00
2701  CALL 1342
2704  LXI  B,8257
2707  DAD  B
2708  PUSH H
2709  LHLD 88D7
270C  MVI  H,00
270E  LXI  B,0001
2711  DAD  B
2712  POP  B
2713  DAD  B
2714  MVI  M,00
2716  LXI  H,88D8
2719  INR  M
271A  JNZ  06D7
271D  CALL 0676
2720  RET
2721  LXI  H,88D9
2724  MOV  M,C
2725  LXI  H,A805
2728  MVI  M,F8
272A  LHLD 88D9
272D  MOV  C,L
272E  MVI  B,00
2730  LXI  H,0884
2733  DAD  B
2734  DAD  B
2735  MOV  E,M
2736  INX  H
2737  MOV  D,M
2738  XCHG
2739  PCHL
273A  LXI  H,0177
273D  SHLD 88AF
2740  LDA  88A7
2743  CPI  14
2745  JNC  077B
2748  LXI  H,889E
274B  MVI  M,00
274D  MVI  A,04
274F  LXI  H,889E
2752  CMP  M
2753  JC   0776
2756  LXI  D,0005
2759  LHLD 88A7
275C  MVI  H,00
275E  CALL 1342
2761  LXI  B,8833
2764  DAD  B
2765  PUSH H
2766  LHLD 889E
2769  MVI  H,00
276B  POP  B
276C  DAD  B
276D  MVI  M,1F
276F  LXI  H,889E
2772  INR  M
2773  JNZ  074D
2776  LXI  H,88A7
2779  INR  M
277A  RET
277B  LDA  88A7
277E  CPI  28
2780  JNC  07B9
2783  LXI  H,889E
2786  MVI  M,00
2788  MVI  A,04
278A  LXI  H,889E
278D  CMP  M
278E  JC   07B4
2791  LDA  88A7
2794  SUI  14
2796  MOV  L,A
```

```
2797  MVI  H,00
2799  LXI  D,0005
279C  CALL 1342
279F  LXI  B,8833
27A2  DAD  B
27A3  PUSH H
27A4  LHLD 889E
27A7  MVI  H,00
27A9  POP  B
27AA  DAD  B
27AB  MVI  M,00
27AD  LXI  H,889E
27B0  INR  M
27B1  JNZ  0788
27B4  LXI  H,88A7
27B7  INR  M
27B8  RET
27B9  LDA  88A7
27BC  CPI  41
27BE  JNC  0818
27C1  LDA  88A7
27C4  SUI  28
27C6  MOV  E,A
27C7  MVI  D,00
27C9  LXI  H,0005
27CC  CALL 1318
27CF  LXI  H,889E
27D2  MOV  M,E
27D3  DCX  H
27D4  MVI  M,00
27D6  MVI  A,13
27D8  LXI  H,889D
27DB  CMP  M
27DC  JC   0801
27DF  LXI  D,0005
27E2  LHLD 889D
27E5  MVI  H,00
27E7  CALL 1342
27EA  LXI  B,8833
27ED  DAD  B
27EE  PUSH H
27EF  LHLD 889E
27F2  MVI  H,00
27F4  POP  B
27F5  DAD  B
27F6  LDA  889F
27F9  MOV  M,A
27FA  LXI  H,889D
27FD  INR  M
27FE  JNZ  07D6
2801  LDA  889F
2804  ORA  A
2805  RAL
2806  STA  889F
2809  CPI  20
280B  JNZ  0813
280E  LXI  H,889F
2811  MVI  M,20
2813  LXI  H,88A7
2816  INR  M
2817  RET
2818  LXI  H,88A6
281B  MVI  M,00
281D  JMP  0888
2820  MVI  A,0F
2822  LXI  H,889E
2825  CMP  M
2826  JNC  0831
2829  LXI  H,88A6
282C  MVI  M,00
282E  JMP  0881
2831  CALL 0318
2834  LXI  H,0465
2837  SHLD 88AF
283A  LXI  H,889D
283D  MVI  M,00
283F  MVI  A,04
2841  LXI  H,889D
2844  CMP  M
2845  JC   086D
2848  LDA  889E
284B  LXI  H,889D
284E  ADD  M
284F  MOV  L,A
2850  MVI  H,00
2852  LXI  D,0005
2855  CALL 1342
2858  LXI  B,8833
285B  DAD  B
285C  PUSH H
285D  LHLD 889F
2860  MVI  H,00
2862  POP  B
2863  DAD  B
2864  MVI  M,1F
2866  LXI  H,889D
2869  INR  M
286A  JNZ  083F
286D  LXI  H,889F
2870  INR  M
2871  MVI  A,04
2873  CMP  M
2874  JNC  0881
2877  LXI  H,889F
287A  MVI  M,00
287C  MVI  A,05
287E  DCX  H
287F  ADD  M
2880  MOV  M,A
2881  JMP  0888
2884  LDA  2007
2887  ??=  08
```

```
2888  RET
2889  LXI  H,88DA
288C  MOV  M,C
288D  CALL 0286
2890  MVI  C,07
2892  CALL 03E4
2895  LHLD 88DA
2898  MOV  C,L
2899  CALL 0373
289C  LDA  9001
289F  ANI  07
28A1  CPI  00
28A3  JNZ  08A9
28A6  JMP  089C
28A9  LDA  9000
28AC  STA  88DB
28AF  RET
28B0  LXI  H,88DC
28B3  MOV  M,C
28B4  MVI  A,01
28B6  LXI  H,88DC
28B9  CMP  M
28BA  JNC  08C2
28BD  LXI  H,88DC
28C0  MVI  M,01
28C2  LHLD 88DC
28C5  MOV  C,L
28C6  MVI  B,00
28C8  LXI  H,08ED
28CB  DAD  B
28CC  DAD  B
28CD  MOV  E,M
28CE  INX  H
28CF  MOV  D,M
28D0  XCHG
28D1  PCHL
28D2  LXI  H,88A7
28D5  MVI  M,00
28D7  LXI  H,889F
28DA  MVI  M,01
28DC  JMP  08F1
28DF  LXI  H,889D
28E2  MVI  M,00
28E4  INX  H
28E5  MVI  M,00
28E7  INX  H
28E8  MVI  M,00
28EA  JMP  08F1
28ED  JNC  DF08
28F0  ??=  08
28F1  LXI  H,004B
28F4  SHLD 88AF
28F7  LXI  H,88A6
28FA  MVI  M,FF
28FC  CALL 0318
28FF  LDA  88A6
2902  CPI  FF
2904  JNZ  0937
2907  LDA  8898
290A  ANI  04
290C  CPI  00
290E  JNZ  0914
2911  JMP  0907
2914  LDA  8898
2917  ANI  FB
2919  STA  8898
291C  MVI  C,00
291E  CALL 14D1
2921  LXI  D,FF00
2924  LXI  H,88AF
2927  CALL 138B
292A  JNC  0934
292D  LHLD 88DC
2930  MOV  C,L
2931  JMP  18E1
2934  JMP  08FF
2937  CALL 0318
293A  RET
293B  LXI  H,A805
293E  MVI  M,FF
2940  LXI  H,88A7
2943  MVI  M,00
2945  MVI  A,06
2947  LXI  H,88A7
294A  CMP  M
294B  JC   0962
294E  LHLD 88A7
2951  MOV  C,L
2952  CALL 03E4
2955  LXI  B,0177
2958  CALL 025F
295B  LXI  H,88A7
295E  INR  M
295F  JNZ  0945
2962  LXI  H,88A7
2965  MVI  M,0B
2967  MVI  A,63
2969  LXI  H,88A7
296C  CMP  M
296D  JC   0991
2970  JMP  0981
2973  LDA  88A7
2976  ADI  0B
2978  STA  88A7
297B  JNC  0967
297E  JMP  0991
2981  LHLD 88A7
2984  MOV  C,L
2985  CALL 0373
2988  LXI  B,0177
298B  CALL 025F
298E  JMP  0973
```

```
2991  LXI  H,A805
2994  MVI  M,FD
2996  IN   80
2998  CMA
2999  ANI  04
299B  CPI  04
299D  JNZ  09EF
29A0  LXI  H,9001
29A3  MVI  M,60
29A5  MVI  M,80
29A7  LXI  H,88A7
29AA  MVI  M,00
29AC  MVI  A,FF
29AE  LXI  H,88A7
29B1  CMP  M
29B2  JC   09EF
29B5  LHLD 88A7
29B8  MOV  C,L
29B9  CALL 0232
29BC  CALL 024C
29BF  STA  889C
29C2  LDA  88A7
29C5  ANI  7F
29C7  LXI  H,889C
29CA  CMP  M
29CB  JZ   09D3
29CE  MVI  C,01
29D0  CALL 0889
29D3  LDA  88A7
29D6  STA  9000
29D9  LXI  H,88A7
29DC  LDA  9000
29DF  CMP  M
29E0  JZ   09E8
29E3  MVI  C,02
29E5  CALL 0889
29E8  LXI  H,88A7
29EB  INR  M
29EC  JNZ  09AC
29EF  RET
29F0  LHLD 88A1          SERIAL INTERRUPT SERVICE
29F3  MOV  C,L
29F4  CALL 0232  — Send output character
29F7  LDA  88A1
29FA  ANI  FF
29FC  CPI  50
29FE  JC   0AB1  (< 50H)
2A01  JMP  0AA4  (> = 50H)
2A04  ANI  07
2A06  MOV  C,A
2A07  MVI  B,00
2A09  LXI  H,0A99
2A0C  DAD  B
2A0D  DAD  B
2A0E  MOV  E,M
2A0F  INX  H
```

```
2A10  MOV  D,M
2A11  XCHG
2A12  PCHL
2A13  LDA  88A1
2A16  ANI  38
2A18  ANI  FC
2A1A  RAR
2A1B  RAR
2A1C  RAR
2A1D  STA  8897
2A20  JMP  0AA3
2A23  LDA  8897
2A26  SUI  02
2A28  SUI  01
2A2A  SBB  A
2A2B  PUSH PSW
2A2C  LDA  8897
2A2F  SUI  03
2A31  SUI  01
2A33  SBB  A
2A34  POP  B
2A35  MOV  C,B
2A36  ORA  C
2A37  RAR
2A38  JNC  0A4A
2A3B  CALL 043F
2A3E  STA  88A9
2A41  LDA  88A9
2A44  DCR  A
2A45  MOV  C,A
2A46  MVI  E,01
2A48  CALL 04E3
2A4B  CALL 035C
2A4E  RET
2A4F  NOP
2A50  NOP
2A51  NOP
2A52  NOP
2A53  NOP
2A54  NOP
2A55  NOP
2A56  LDA  8897
2A59  SUI  02
2A5B  SUI  01
2A5D  SBB  A
2A5E  PUSH PSW
2A5F  LDA  8897
2A62  SUI  03
2A64  SUI  01
2A66  SBB  A
2A67  POP  B
2A68  MOV  C,B
2A69  ORA  C
2A6A  RAR
2A6B  JNC  0AA3
2A6E  JMP  0D27
2A71  CALL 0318
2A74  JMP  2D30
2A77  MVI  M,00
2A79  DCX  H
2A7A  MVI  M,00
2A7C  JMP  0AA3
2A7F  LDA  88A1
2A82  ANI  08
2A84  CPI  00
2A86  JNZ  0A91
2A89  MVI  C,40
2A8B  CALL 1396
2A8E  JMP  0A96
2A91  MVI  C,C0
2A93  CALL 1396
2A96  JMP  0AA3
2A99  INX  D
2A9A  LDAX B
2A9B  INX  H
2A9C  LDAX B
2A9D  MOV  C,L
2A9E  LDAX B
2A9F  MOV  D,M
2AA0  LDAX B
2AA1  MOV  A,A
2AA2  LDAX B
2AA3  RET
2AA4  LDA  88A1
2AA7  CPI  5C
2AA9  JC   0A04
2AAC  SUI  5C
2AAE  JMP  19F2
2AB1  LDA  8897
2AB4  CPI  03
2AB6  JNZ  0AA3
2AB9  LHLD 88A1
2ABC  MOV  C,L
2ABD  CALL 0373
2AC0  LHLD 88A1
2AC3  MOV  C,L
2AC4  CALL 041E
2AC7  LDA  88A1
2ACA  DCR  A
2ACB  MOV  C,A
2ACC  MVI  E,00
2ACE  CALL 04E3
2AD1  LDA  88A1
2AD4  DCR  A
2AD5  MOV  E,A
2AD6  MVI  D,00
2AD8  LXI  H,000F
2ADB  CALL 1318
2ADE  MOV  C,E
2ADF  CALL 03E4
2AE2  LXI  H,88A3
2AE5  JMP  1713
2AE8  NOP
2AE9  LDA  88B1
```

JUMP TABLE

```
2AEC  CPI  15
2AEE  JNC  0B52
2AF1  LDA  88A3
2AF4  CPI  FF
2AF6  JNZ  0B04
2AF9  LXI  H,88A3
2AFC  MVI  M,00
2AFE  CALL 0286
2B01  CALL 035C
2B04  LDA  88B1
2B07  CPI  05
2B09  JC   0B22
2B0C  LDA  88B1
2B0F  CPI  0D
2B11  JNC  0B1F
2B14  LDA  88B1
2B17  SUI  03
2B19  STA  88B1
2B1C  JMP  0B22
2B1F  JMP  0B43
2B22  LDA  889A
2B25  STA  8899
2B28  LDA  88B1
2B2B  STA  889A
2B2E  LHLD 8899
2B31  MVI  H,00
2B33  CALL 133B
2B36  PUSH H
2B37  LHLD 889A
2B3A  MVI  H,00
2B3C  POP  B
2B3D  DAD  B
2B3E  MOV  C,L
2B3F  CALL 0373
2B42  RET
2B43  LDA  88B1
2B46  SUI  10
2B48  MOV  C,A
2B49  CALL 03E4
2B4C  LXI  H,88A4
2B4F  MVI  M,FF
2B51  RET
2B52  LDA  88B1
2B55  CPI  19
2B57  JNZ  0C13
2B5A  LDA  88A3
2B5D  CPI  00
2B5F  JNZ  0BC2
2B62  LXI  H,9001
2B65  MVI  M,66
2B67  DCX  H
2B68  MOV  A,M
2B69  CPI  00
2B6B  JNZ  0BA2
2B6E  LDA  88A4
2B71  CPI  00
2B73  JNZ  0B79
2B76  JMP  0BC2
2B79  MVI  C,05
2B7B  CALL 03E4
2B7E  LXI  H,88A4
2B81  MVI  M,00
2B83  LDA  8897
2B86  SUI  01
2B88  SUI  01
2B8A  SBB  A
2B8B  PUSH PSW
2B8C  MVI  A,00
2B8E  LXI  H,88A0
2B91  SUB  M
2B92  SBB  A
2B93  POP  B
2B94  MOV  C,B
2B95  ANA  C
2B96  RAR
2B97  JNC  0B9F
2B9A  LXI  H,88A3
2B9D  MVI  M,FF
2B9F  JMP  0BAE
2BA2  MVI  A,00
2BA4  STA  889A
2BA7  STA  8899
2BAA  MOV  C,A
2BAB  CALL 0373
2BAE  RET
2BAF  ADC  B
2BB0  MVI  H,00
2BB2  CALL 133B
2BB5  PUSH H
2BB6  LHLD 889A
2BB9  MVI  H,00
2BBB  POP  B
2BBC  DAD  B
2BBD  MOV  C,L
2BBE  CALL 0373
2BC1  RET
2BC2  LDA  8897
2BC5  SUI  01
2BC7  SUI  01
2BC9  SBB  A
2BCA  PUSH PSW
2BCB  LDA  8897
2BCE  SUI  00
2BD0  SUI  01
2BD2  SBB  A
2BD3  POP  B
2BD4  MOV  C,B
2BD5  ORA  C
2BD6  RAR
2BD7  JNC  0C13
2BDA  MVI  A,00
2BDC  LXI  H,88A0
```

```
2BDF  CMP  M
2BE0  JNC  0C06
2BE3  LDA  8897
2BE6  CPI  00
2BE8  JNZ  0BF0
2BEB  MVI  C,59
2BED  CALL 0232
2BF0  CALL 043F
2BF3  STA  88A9
2BF6  LDA  88A9
2BF9  DCR  A
2BFA  MOV  C,A
2BFB  MVI  E,01
2BFD  CALL 04E3
2C00  CALL 035C
2C03  JMP  0C13
2C06  LXI  H,88A3
2C09  MVI  M,FF
2C0B  CALL 0286
2C0E  MVI  C,06
2C10  CALL 03E4
2C13  LDA  88B1
2C16  CPI  1A
2C18  JNZ  0CFE
2C1B  LHLD 8899
2C1E  MVI  H,00
2C20  CALL 133B
2C23  PUSH H
2C24  LHLD 889A
2C27  MVI  H,00
2C29  POP  B
2C2A  DAD  B
2C2B  XCHG
2C2C  LXI  H,88A9
2C2F  MOV  M,E
2C30  DCR  E
2C31  MVI  A,4A
2C33  CMP  E
2C34  JNC  0C48
2C37  CALL 0286
2C3A  MVI  C,06
2C3C  CALL 03E4
2C3F  LXI  H,88A3
2C42  MVI  M,00
2C44  INX  H
2C45  MVI  M,00
2C47  RET
2C48  LDA  8897
2C4B  CPI  03
2C4D  JNZ  0C56
2C50  LDA  88A2
2C53  STA  88A9
2C56  LDA  8897
2C59  CPI  02
2C5B  JNZ  0C75
2C5E  LXI  H,88A2
2C61  LDA  88A9
2C64  CMP  M
2C65  JZ   0C75
2C68  LDA  88A2
2C6B  STA  88A9
2C6E  LHLD 88A9
2C71  MOV  C,L
2C72  CALL 0373
2C75  LXI  H,889C
2C78  MVI  M,00
2C7A  MVI  A,00
2C7C  LXI  H,88A0
2C7F  CMP  M
2C80  JNC  0CAF
2C83  LXI  H,88DD
2C86  MVI  M,00
2C88  LDA  88A0
2C8B  DCR  A
2C8C  LXI  H,88DD
2C8F  CMP  M
2C90  JC   0CAF
2C93  LHLD 88DD
2C96  MVI  H,00
2C98  LXI  B,8200
2C9B  DAD  B
2C9C  LDA  88A9
2C9F  CMP  M
2CA0  JNZ  0CA8
2CA3  JMP  19A9
2CA6  MVI  M,FF
2CA8  LXI  H,88DD
2CAB  INR  M
2CAC  JNZ  0C88
2CAF  LDA  88A0
2CB2  SUI  4B
2CB4  SBB  A
2CB5  PUSH PSW
2CB6  LDA  889C
2CB9  SUI  00
2CBB  SUI  01
2CBD  SBB  A
2CBE  POP  B
2CBF  MOV  C,B
2CC0  ANA  C
2CC1  RAR
2CC2  JNC  0C37
2CC5  LDA  8897
2CC8  CPI  00
2CCA  JNZ  0CD4
2CCD  LHLD 88A9
2CD0  MOV  C,L
2CD1  CALL 0232
2CD4  LHLD 88A9
2CD7  MOV  C,L
2CD8  CALL 041E
2CDB  LDA  88A9
2CDE  DCR  A
2CDF  MOV  C,A
```

```
2CE0  MVI  E,00
2CE2  CALL 04E3
2CE5  LDA  88A9
2CE8  DCR  A
2CE9  MOV  E,A
2CEA  MVI  D,00
2CEC  LXI  H,000F
2CEF  CALL 1318
2CF2  MOV  C,E
2CF3  CALL 03E4
2CF6  LXI  H,88A3
2CF9  MVI  M,FF
2CFB  CALL 0368
2CFE  LDA  88B1
2D01  SUI  59
2D03  SUI  01
2D05  SBB  A
2D06  PUSH PSW
2D07  LDA  8897
2D0A  SUI  00
2D0C  SUI  01
2D0E  SBB  A
2D0F  PUSH PSW
2D10  LDA  8897
2D13  SUI  01
2D15  SUI  01
2D17  SBB  A
2D18  POP  B
2D19  MOV  C,B
2D1A  ORA  C
2D1B  POP  B
2D1C  MOV  C,B
2D1D  ANA  C
2D1E  RAR
2D1F  JNC  17E2
2D22  MVI  C,5B
2D24  CALL 0232
2D27  CALL 0286
2D2A  CALL 02AE
2D2D  CALL 0318
2D30  MVI  C,01
2D32  CALL 08B0
2D35  CALL 0368
2D38  JMP  1770
2D3B  LXI  H,88DD
2D3E  MVI  M,00
2D40  MVI  A,04
2D42  LXI  H,88DD
2D45  CMP  M
2D46  JC   0D8B
2D49  LHLD 88DD
2D4C  MVI  H,00
2D4E  LXI  B,8252
2D51  DAD  B
2D52  MVI  A,01
2D54  ANA  M
2D55  CPI  00
2D57  JZ   0D66
2D5A  LHLD 88DD
2D5D  MVI  H,00
2D5F  DAD  H
2D60  MOV  C,L
2D61  MVI  E,FF
2D63  CALL 05C6
2D66  LHLD 88DD
2D69  MVI  H,00
2D6B  LXI  B,8252
2D6E  DAD  B
2D6F  MVI  A,02
2D71  ANA  M
2D72  CPI  00
2D74  JZ   0D84
2D77  LHLD 88DD
2D7A  MVI  H,00
2D7C  DAD  H
2D7D  INX  H
2D7E  MOV  C,L
2D7F  MVI  E,FF
2D81  CALL 05C6
2D84  LXI  H,88DD
2D87  INR  M
2D88  JNZ  0D40
2D8B  RET
2D8C  LXI  H,88E1
2D8F  MOV  M,D
2D90  DCX  H
2D91  MOV  M,E
2D92  DCX  H
2D93  MOV  M,B
2D94  DCX  H
2D95  MOV  M,C
2D96  LXI  B,0003
2D99  LHLD 88E0
2D9C  DAD  B
2D9D  LXI  B,0007
2DA0  PUSH H
2DA1  LHLD 88E0
2DA4  DAD  B
2DA5  MOV  A,M
2DA6  POP  H
2DA7  ADD  M
2DA8  MOV  E,A
2DA9  MVI  D,00
2DAB  LXI  H,0002
2DAE  CALL 1318
2DB1  XCHG
2DB2  SHLD 88EE
2DB5  LXI  H,88E2
2DB8  MVI  M,00
2DBA  MVI  A,03
2DBC  LXI  H,88E2
2DBF  CMP  M
```

```
2DC0  JC   0DDA
2DC3  LHLD 88E2
2DC6  MVI  H,00
2DC8  LXI  B,88EA
2DCB  DAD  B
2DCC  PUSH H
2DCD  LHLD 88EE
2DD0  XCHG
2DD1  POP  H
2DD2  MOV  M,E
2DD3  LXI  H,88E2
2DD6  INR  M
2DD7  JNZ  0DBA
2DDA  LXI  H,88E5
2DDD  MVI  M,07
2DDF  LXI  H,88E9
2DE2  MVI  M,00
2DE4  LXI  H,88E3
2DE7  MVI  M,00
2DE9  MVI  A,19
2DEB  LXI  H,88E3
2DEE  CMP  M
2DEF  JC   0EEC
2DF2  LXI  H,88E8
2DF5  MVI  M,00
2DF7  LXI  H,88E4
2DFA  MVI  M,00
2DFC  MVI  A,03
2DFE  LXI  H,88E4
2E01  CMP  M
2E02  JC   0EAE
2E05  LXI  H,88E5
2E08  INR  M
2E09  INR  M
2E0A  LXI  H,0000
2E0D  SHLD 88EE
2E10  MOV  A,L
2E11  STA  88E2
2E14  MVI  A,03
2E16  LXI  H,88E2
2E19  CMP  M
2E1A  JC   0E37
2E1D  LHLD 88E2
2E20  MVI  H,00
2E22  LXI  B,88EA
2E25  DAD  B
2E26  MOV  E,M
2E27  MVI  D,00
2E29  LHLD 88EE
2E2C  DAD  D
2E2D  SHLD 88EE
2E30  LXI  H,88E2
2E33  INR  M
2E34  JNZ  0E14
2E37  LHLD 88E5
2E3A  MVI  H,00
2E3C  XCHG
2E3D  LHLD 88E0
2E40  DAD  D
2E41  MOV  A,M
2E42  ADD  A
2E43  ADD  A
2E44  MOV  L,A
2E45  MVI  H,00
2E47  SHLD 88E6
2E4A  MVI  C,01
2E4C  CALL 135A
2E4F  XCHG
2E50  LHLD 88E6
2E53  DAD  D
2E54  SHLD 88E6
2E57  LXI  D,88EE
2E5A  CALL 1380
2E5D  JNC  0E9F
2E60  LXI  H,88E2
2E63  MVI  M,00
2E65  MVI  A,02
2E67  LXI  H,88E2
2E6A  CMP  M
2E6B  JC   0E89
2E6E  LHLD 88E2
2E71  MVI  H,00
2E73  LXI  B,88EB
2E76  DAD  B
2E77  PUSH H
2E78  LHLD 88E2
2E7B  MVI  H,00
2E7D  DCX  B
2E7E  DAD  B
2E7F  POP  D
2E80  LDAX D
2E81  MOV  M,A
2E82  LXI  H,88E2
2E85  INR  M
2E86  JNZ  0E65
2E89  LHLD 88E5
2E8C  MVI  H,00
2E8E  XCHG
2E8F  LHLD 88E0
2E92  DAD  D
2E93  MOV  A,M
2E94  STA  88ED
2E97  LDA  88E8
2E9A  ORI  10
2E9C  STA  88E8
2E9F  LDA  88E8
2EA2  ORA  A
2EA3  RAR
2EA4  STA  88E8
2EA7  LXI  H,88E4
2EAA  INR  M
2EAB  JNZ  0DFC
```

```
2EAE  LDA  88E3
2EB1  SUI  18
2EB3  SBB  A
2EB4  PUSH PSW
2EB5  LDA  88E8
2EB8  SUI  00
2EBA  SUI  01
2EBC  SBB  A
2EBD  POP  B
2EBE  MOV  C,B
2EBF  ANA  C
2EC0  RAR
2EC1  JNC  0EC7
2EC4  MVI  A,FF
2EC6  RET
2EC7  LHLD 88E3
2ECA  MVI  H,00
2ECC  XCHG
2ECD  LHLD 88DE
2ED0  DAD  D
2ED1  LDA  88E8
2ED4  MOV  M,A
2ED5  LDA  88E3
2ED8  CPI  18
2EDA  JNC  0EE5
2EDD  LDA  88E8
2EE0  LXI  H,88E9
2EE3  ADD  M
2EE4  MOV  M,A
2EE5  LXI  H,88E3
2EE8  INR  M
2EE9  JNZ  0DE9
2EEC  LXI  B,0018
2EEF  LHLD 88DE
2EF2  DAD  B
2EF3  PUSH H
2EF4  LHLD 88DE
2EF7  INX  B
2EF8  DAD  B
2EF9  MOV  L,M
2EFA  MVI  H,00
2EFC  DAD  H
2EFD  DAD  H
2EFE  DAD  H
2EFF  DAD  H
2F00  XTHL
2F01  MOV  L,M
2F02  MVI  H,00
2F04  POP  D
2F05  DAD  D
2F06  LDA  88E9
2F09  CALL 1366
2F0C  ORA  L
2F0D  JZ   0F13
2F10  MVI  A,FF
2F12  RET
2F13  LXI  H,88E3
2F16  MVI  M,18
2F18  MVI  A,0C
2F1A  LXI  H,88E3
2F1D  CMP  M
2F1E  JNC  0F41
2F21  LDA  88E3
2F24  DCR  A
2F25  MOV  C,A
2F26  MVI  B,00
2F28  LHLD 88DE
2F2B  DAD  B
2F2C  PUSH H
2F2D  LHLD 88E3
2F30  MVI  H,00
2F32  XCHG
2F33  LHLD 88DE
2F36  DAD  D
2F37  POP  B
2F38  LDAX B
2F39  MOV  M,A
2F3A  LXI  H,88E3
2F3D  DCR  M
2F3E  JMP  0F18
2F41  LXI  H,88E3
2F44  MVI  M,00
2F46  MVI  A,18
2F48  LXI  H,88E3
2F4B  CMP  M
2F4C  JC   0F7F
2F4F  LHLD 88E3
2F52  MVI  H,00
2F54  XCHG
2F55  LHLD 88DE
2F58  DAD  D
2F59  PUSH H
2F5A  LHLD 88E3
2F5D  MVI  H,00
2F5F  XCHG
2F60  LXI  H,0005
2F63  CALL 1318
2F66  LXI  H,000F
2FDC  ANI  FB
2FDE  STA  8898
2FE1  MVI  C,00
2FE3  CALL 14D1
2FE6  LXI  D,FFF0
2FE9  LXI  H,88AF
2FEC  CALL 138B
2FEF  JNC  1039
2FF2  LDA  88F0
2FF5  RAR
2FF6  JNC  1005
2FF9  LHLD 88AB
2FFC  MOV  C,L
2FFD  MVI  E,00
```

```
2FFF  CALL 05C6
3002  JMP  100E
3005  LHLD 88AB
3008  MOV  C,L
3009  MVI  E,FF
300B  CALL 05C6
300E  LXI  H,88F0
3011  INR  M
3012  LXI  H,00BB
3015  SHLD 88AF
3018  LDA  88AA
301B  ORI  F8
301D  STA  A805
3020  IN   80
3022  LXI  H,88F2
3025  ANA  M
3026  ANI  F0
3028  CPI  00
302A  JNZ  1034
302D  LXI  H,88F1
3030  INR  M
3031  JMP  1039
3034  LXI  H,88F1
3037  MVI  M,00
3039  JMP  0FC4
303C  LHLD 88AB
303F  MOV  C,L
3040  MVI  E,00
3042  CALL 05C6
3045  LHLD 88AA
3048  MVI  H,00
304A  LXI  B,8252
304D  DAD  B
304E  LDA  88F2
3051  CMA
3052  ANA  M
3053  MOV  M,A
3054  LHLD 88AB
3057  MOV  C,L
2F69  CALL 1342
2F6C  XTHL
2F6D  PUSH H
2F6E  MOV  L,M
2F6F  MVI  H,00
2F71  POP  B
2F72  POP  D
2F73  DAD  D
2F74  XCHG
2F75  MOV  H,B
2F76  MOV  L,C
2F77  MOV  M,E
2F78  LXI  H,88E3
2F7B  INR  M
2F7C  JNZ  0F46
2F7F  LXI  B,000C
2F82  LHLD 88DE
2F85  DAD  B
2F86  MVI  M,00
2F88  MVI  A,00
2F8A  RET
2F8B  LXI  H,00BB
2F8E  SHLD 88AF
2F91  LXI  H,88F0
2F94  MVI  M,00
2F96  INX  H
2F97  MVI  M,00
2F99  LHLD 88AB
2F9C  MOV  C,L
2F9D  MVI  E,FF
2F9F  CALL 05C6
2FA2  LHLD 88AB
2FA5  MVI  H,00
2FA7  XCHG
2FAB  LXI  H,0002
2FAB  CALL 1318
2FAE  MVI  A,00
2FB0  CALL 1366
2FB3  ORA  L
2FB4  JNZ  0FBF
2FB7  LXI  H,88F2
2FBA  MVI  M,35
2FBC  JMP  0FC4
2FBF  LXI  H,88F2
2FC2  MVI  M,CA
2FC4  LDA  88F1
2FC7  CPI  08
2FC9  JNC  103C
2FCC  LDA  8898
2FCF  ANI  04
2FD1  CPI  00
2FD3  JNZ  0FD9
2FD6  JMP  0FCC
2FD9  LDA  8898
305B  CALL 06C5
305B  RET
305C  LHLD 88AB
305F  MVI  H,00
3061  XCHG
3062  LXI  H,0002
3065  CALL 1318
3068  MVI  A,00
306A  CALL 1366
306D  ORA  L
306E  JNZ  107F
3071  MVI  C,40
3073  CALL 1396
3076  CALL 155C
3079  STA  88F4
307C  JMP  108A
307F  MVI  C,C0
3081  CALL 1396
3084  CALL 15A8
```

```
308A  STA  88F4
308A  LDA  88F4
308D  CPI  00
308F  JNZ  10AA
3092  LXI  D,8000
3095  LXI  B,80DC
3098  CALL 0D8C
309B  STA  88F4
309E  LXI  D,8100
30A1  LXI  B,81DC
30A4  CALL 0D8C
30A7  STA  88F5
30AA  LDA  88F5
30AD  LXI  H,88F4
30B0  ORA  M
30B1  CPI  00
30B3  JNZ  115B
30B6  LHLD 88AB
30B9  MVI  H,00
30BB  DAD  H
30BC  XCHG
30BD  LXI  H,88F3
30C0  MOV  M,E
30C1  LHLD 88F3
30C4  MOV  C,L
30C5  LXI  D,80DC
30C8  CALL 0487
30CB  LDA  88F3
30CE  INR  A
30CF  MOV  C,A
30D0  LXI  D,81DC
30D3  CALL 0487
30D6  LHLD 88AB
30D9  MOV  C,L
30DA  MVI  E,FF
30DC  CALL 05C6
30DF  LHLD 88AA
30E2  MVI  H,00
30E4  LXI  B,8252
30E7  DAD  B
30EB  MOV  A,M
30E9  STA  889C
30EC  LHLD 88AB
30EF  MVI  H,00
30F1  XCHG
30F2  LXI  H,0002
30F5  CALL 1318
30F8  MVI  A,00
30FA  CALL 1366
30FD  ORA  L
30FE  JNZ  1113
3101  LDA  889C
3104  ORI  31
3106  LHLD 88AA
3109  MVI  H,00
310B  LXI  B,8252
310E  DAD  B
310F  MOV  M,A
3110  JMP  1122
3113  LDA  889C
3116  ORI  C2
3118  LHLD 88AA
311B  MVI  H,00
311D  LXI  B,8252
3120  DAD  B
3121  MOV  M,A
3122  MVI  A,00
3124  LXI  H,88A0
3127  CMP  M
3128  JNC  1153
312B  LXI  H,889B
312E  MVI  M,00
3130  LDA  88A0
3133  DCR  A
3134  LXI  H,889B
3137  CMP  M
3138  JC   1153
313B  LHLD 889B
313E  MVI  H,00
3140  LXI  B,8200
3143  DAD  B
3144  MOV  A,M
3145  DCR  A
3146  MOV  C,A
3147  MVI  E,00
3149  CALL 04E3
314C  LXI  H,889B
314F  INR  M
3150  JNZ  1130
3153  LXI  H,88AE
3156  MVI  M,00
3158  JMP  196F
315B  LXI  H,88AE
315E  MVI  M,00
3160  JMP  17B0
3163  RET
3164  LXI  H,88AA
3167  MVI  M,00
3169  MVI  A,04
316B  LXI  H,88AA
316E  CMP  M
316F  JC   11C1
3172  LDA  88AA
3175  ADI  F8
3177  STA  A805
317A  IN   80
317C  ANI  F0
317E  STA  88F6
3181  ANI  30
3183  CPI  00
3185  JZ   118D
3188  MVI  A,00
```

```
318A  CALL 11A7
318D  LDA  88F6
3190  ANI  C0
3192  CPI  00
3194  JZ   119C
3197  MVI  A,01
3199  CALL 11A7
319C  CALL 11AE
319F  LXI  H,88AA
31A2  INR  M
31A3  JNZ  1169
31A6  RET
31A7  CALL 1700
31AA  CALL 1720
31AD  RET
31AE  LHLD 88AA
31B1  MVI  H,00
31B3  LXI  B,8252
31B6  DAD  B
31B7  LDA  88F6
31BA  MOV  M,A
31BB  RET
31BC  ADC  B
31BD  INR  M
31BE  JNZ  1169
31C1  RET
31C2  MVI  C,18      Cold START
31C4  CALL 1396   E
31C7  EI
31C8  CALL 1164
31CB  CALL 0286
31CE  MVI  C,00
31D0  CALL 08B0
31D3  CALL 0286
31D6  CALL 0318
31D9  CALL 02D4
31DC  CALL 02AE
31DF  LXI  H,88A8
31E2  MVI  M,A3
31E4  LXI  H,88A5
31E7  MVI  M,00
31E9  LXI  H,88A3
31EC  MVI  M,FF
31EE  LDA  9801
31F1  ANI  80
31F3  CPI  00
31F5  JNZ  1600
31F8  LXI  H,8897
31FB  MVI  M,00
31FD  MVI  C,58
31FF  CALL 0232
3202  JMP  1605
3205  NOP
3206  NOP
3207  NOP
3208  NOP
3209  NOP
```

called

```
320A  LDA  8898   Wait for Timer interrupt
320D  ANI  04
320F  CPI  00
3211  JNZ  1217
3214  JMP  120A
3217  LDA  8898
321A  ANI  FB     - clear flag
321C  STA  8898
321F  MVI  C,FF
3221  CALL 14D1   - service interrupt
3224  LDA  8898   - check for Serial interrupt
3227  ANI  01
3229  CPI  01
322B  JNZ  1239   skip if none
322E  LDA  8898   Else clear flag
3231  ANI  FE
3233  STA  8898
3236  CALL 09F0   - service Serial ~~input~~ INTERRUPT
3239  LDA  8898   Check Keypad Flag
323C  ANI  02
323E  CPI  02
3240  JNZ  1251   skip if no key entry
3243  LDA  8898   Else clear flag
3246  ANI  FD
3248  STA  8898
324B  CALL 18D0   And service interrupt
324E  JMP  128D
3251  LDA  88A5
3254  SUI  FF
3256  SUI  01
3258  SBB  A
3259  LXI  D,FF00
325C  LXI  H,88AF
325F  PUSH PSW
3260  CALL 138B
3263  SBB  A
3264  POP  B
3265  MOV  C,B
3266  ANA  C
3267  RAR
3268  JNC  128D
326B  LDA  88A8
326E  XRI  03
3270  STA  88A8
3273  STA  9001
3276  LDA  88A8
3279  CPI  A3
327B  JNZ  1287
327E  LXI  H,00BB
3281  SHLD 88AF
3284  JMP  128D
3287  LXI  H,02EE
328A  SHLD 88AF
328D  LHLD 88AA
3290  MVI  H,00
3292  LXI  B,8252
3295  DAD  B
```

```
3296  MOV   A,M
3297  STA   889C
329A  ANI   F0
329C  LXI   H,88AD
329F  XRA   M
32A0  INX   H
32A1  MOV   M,A
32A2  CPI   00
32A4  RET
32A5  NOP
32A6  NOP
32A7  LDA   889C
32AA  ANI   0F
32AC  LXI   H,88AD
32AF  ORA   M
32B0  LHLD  88AA
32B3  MVI   H,00
32B5  LXI   B,8252
32B8  DAD   B
32B9  MOV   M,A
32BA  LDA   88AE
32BD  ANI   30
32BF  CPI   00
32C1  JZ    12ED
32C4  LHLD  88AA
32C7  MVI   H,00
32C9  DAD   H
32CA  XCHG
32CB  LXI   H,88AB
32CE  MOV   M,E
32CF  LDA   889C
32D2  ANI   01
32D4  CPI   00
32D6  JNZ   12DF
32D9  CALL  105C
32DC  JMP   12EA
32DF  LXI   H,88AE
32E2  MVI   M,00
32E4  CALL  0676
32E7  CALL  17B0
32EA  JMP   1314
32ED  LHLD  88AA
32F0  MVI   H,00
32F2  DAD   H
32F3  INX   H
32F4  XCHG
32F5  LXI   H,88AB
32F8  MOV   M,E
32F9  LDA   889C
32FC  ANI   02
32FE  CPI   00
3300  JNZ   1309
3303  CALL  105C
3306  JMP   1314
3309  LXI   H,88AE
330C  MVI   M,00
330E  CALL  0676
3311  CALL  17B0
3314  JMP   1618
3317  RET
3318  MOV   B,H
3319  MOV   C,L
331A  LXI   H,0000
331D  MVI   A,10
331F  PUSH  PSW
3320  DAD   H
3321  XCHG
3322  SUB   A
3323  DAD   H
3324  XCHG
3325  ADC   L
3326  SUB   C
3327  MOV   L,A
3328  MOV   A,H
3329  SBB   B
332A  MOV   H,A
332B  INX   D
332C  JNC   1331
332F  DAD   B
3330  DCX   D
3331  POP   PSW
3332  DCR   A
3333  JNZ   131F
3336  RET
3337  MOV   E,M
3338  INX   H
3339  MOV   D,M
333A  XCHG
333B  DAD   H
333C  PUSH  H
333D  DAD   H
333E  DAD   H
333F  POP   B
3340  DAD   B
3341  RET
3342  MOV   B,H
3343  MOV   C,L
3344  LXI   H,0000
3347  MVI   A,10
3349  DAD   H
334A  XCHG
334B  DAD   H
334C  XCHG
334D  JNC   1351
3350  DAD   B
3351  DCR   A
3352  JNZ   1349
3355  RET
3356  MOV   E,M
3357  INX   H
3358  MOV   D,M
3359  XCHG
335A  MOV   A,H
335B  ORA   A
```

```
335C  RAR
335D  MOV  H,A
335E  MOV  A,L
335F  RAR
3360  MOV  L,A
3361  DCR  C
3362  JNZ  135A
3365  RET
3366  MOV  E,A
3367  MVI  D,00
3369  MOV  A,E
336A  SUB  L
336B  MOV  L,A
336C  MOV  A,D
336D  SBB  H
336E  MOV  H,A
336F  RET
3370  MOV  L,C
3371  MOV  H,B
3372  MOV  C,M
3373  INX  H
3374  MOV  B,M
3375  LDAX D
3376  SUB  C
3377  MOV  L,A
3378  INX  D
3379  LDAX D
337A  SBB  B
337B  MOV  H,A
337C  RET
337D  MOV  L,A
337E  MVI  H,00
3380  LDAX D
3381  SUB  L
3382  MOV  L,A
3383  INX  D
3384  LDAX D
3385  SBB  H
3386  MOV  H,A
3387  RET
3388  MOV  E,A
3389  MVI  D,00
338B  MOV  A,E
338C  SUB  M
338D  MOV  E,A
338E  MOV  A,D
338F  INX  H
3390  SBB  M
3391  MOV  D,A
3392  XCHG
3393  RET
3394  ??=  20   RIM
3395  RET
3396  MOV  A,C
3397  ??=  30   SIM
3398  RET
3399  PUSH PSW   POWER FAIL
```

```
339A  PUSH B
339B  PUSH D
339C  PUSH H
339D  LXI  H,0000   Save SP
33A0  DAD  SP
33A1  SHLD 88FE
33A4  MVI  A,70
33A6  STA  9001
33A9  MVI  C,08     Store display state
33AB  LXI  H,8900
33AE  LDA  9000
33B1  MOV  M,A
33B2  INX  H
33B3  DCR  C
33B4  JNZ  13AE
33B7  CALL 14BA     Store memory check sum
33BA  MOV  A,H
33BB  CMA
33BC  MOV  H,A
33BD  MOV  A,L
33BE  CMA
33BF  MOV  L,A
33C0  INX  H
33C1  SHLD 8FFE
33C4  MVI  A,C0
33C6  ??=  30 — Disable interrupts
33C7  HLT  —  stop
33C8  PUSH PSW      Serial input interrupt
33C9  LDA  9800
33CC  ANI  FF
33CE  STA  88A1 — input character
33D1  LDA  8898 — set flag
33D4  ORI  01
33D6  STA  8898
33D9  POP  PSW
33DA  EI
33DB  RET
33DC  PUSH PSW      Read Keypad
33DD  MVI  A,40     Set 8279 to read FIFO
33DF  STA  9001
33E2  LDA  9000     Get raw keycode
33E5  STA  88B1     Store
33E8  LDA  8898     Set status flag
33EB  ORI  02
33ED  STA  8898
33F0  POP  PSW
33F1  EI
33F2  RET
33F3  PUSH PSW      Display Scan Clock Interrupt
33F4  PUSH H
33F5  LDA  8898     Set status flag
33F8  ORI  04 —
33FA  STA  8898
33FD  LHLD 88AF — Decrement pattern pointer
3400  DCX  H
3401  SHLD 88AF
```

```
3404  POP  H
3405  POP  PSW
3406  EI
3407  RET
3408  LHLD 8FFE   — check RAM sample value
340B  MOV  A,H
340C  ORA  L
340D  JZ   1423 — skip if warm start
3410  LXI  SP,8FEE — Else reset SP
3413  CALL 14AD   — Clear all RAM
3416  LXI  H,8833 —
3419  SHLD 88F8
341C  XRA  A
341D  STA  88F7
3420  JMP  11C2
3423  LXI  H,8252      warm Start
3426  LXI  B,0004
3429  DAD  B
342A  MVI  C,04
342C  MOV  A,C
342D  ORI  F8
342F  STA  A805
3432  IN   80
3434  ANI  F0
3436  MOV  B,A
3437  MOV  A,M
3438  ANI  F0
343A  CMP  B
343B  JNZ  1410
343E  DCX  H
343F  DCR  C
3440  JP   142C
3443  LDA  88AA
3446  STA  A805
3449  MVI  A,90
344B  STA  9001
344E  MVI  C,08
3450  LXI  H,8900
3453  MOV  A,M
3454  STA  9000
3457  INX  H
3458  DCR  C
3459  JNZ  1453
345C  MVI  A,18
345E  ??=  30   SIM — Set Interrupts on
345F  LHLD 88FE
3462  SPHL
3463  POP  H
3464  POP  D
3465  POP  B
3466  POP  PSW
3467  EI
3468  RET
3469  LXI  H,9801      INITIALIZE 8251
346C  MVI  A,00
346E  CALL 149C
3471  CALL 149C
```

```
3474  CALL 149C
3477  MVI  A,40
3479  CALL 149C
347C  MVI  A,5E
347E  CALL 149C
3481  MVI  A,05
3483  CALL 149C
3486  LDA  9800   Read 8251 data port to clear it
3489  MVI  A,00
348B  STA  9001   Initialize 8279
348E  MVI  A,28
3490  STA  9001
3493  MVI  A,D3
3495  STA  9001
3498  CALL 14A4
349B  RET
349C  MOV  M,A    send command to 8251
349D  MVI  B,04   Delay 20µS
349F  DCR  B
34A0  JNZ  149F
34A3  RET
34A4  MVI  A,92
34A6  DCR  A  4
34A7  CPI  FF 7   3mS delay
34A9  JNZ  14A6 10
34AC  RET
34AD  LXI  H,8000 clear memory
34B0  XRA  A
34B1  MOV  M,A
34B2  INX  H
34B3  MOV  A,H
34B4  CPI  8F
34B6  JNZ  14B0
34B9  RET
34BA  LXI  D,8000 SET JUMP interrupts
34BD  LXI  H,0000 clear H/L
34C0  LDAX D      Read byte
34C1  MOV  C,A    Store
34C2  MVI  E,80   shift up 188 bytes
34C4  LDAX D      Read                on Exit, H/L
34C5  MOV  B,A    Store
34C6  DAD  B
34C7  MVI  E,00   Move to next page
34C9  INR  D
34CA  MOV  A,D    Done with +R block?
34CB  CPI  90     No continue
34CD  JC   14C0
34D0  RET
34D1  MOV  A,C
34D2  ANA  A
34D3  JZ   14EF
34D6  LDA  88AA
34D9  INR  A
34DA  CPI  05
34DC  JC   14E0
34DF  XRA  A
34E0  STA  88AA
```

```
34E3  ORI  F8
34E5  STA  A805
34E8  IN   80
34EA  ANI  F0
34EC  STA  88AD
34EF  LDA  88F7
34F2  CPI  08
34F4  JC   1501
34F7  CPI  10
34F9  JC   1506
34FC  MVI  A,18
34FE  JMP  1508
3501  MVI  A,30
3503  JMP  1508
3506  MVI  A,28
3508  MOV  B,A
3509  LXI  D,A800
350C  LHLD 88F8
350F  MVI  A,F8
3511  STA  A805
3514  MVI  C,05
3516  MOV  A,M
3517  STAX D
3518  INX  H
3519  INX  D
351A  DCR  C
351B  JNZ  1516
351E  SHLD 88F8
3521  LDA  88F7
3524  MOV  C,A
3525  ANI  07
3527  ORA  B
3528  STA  A805
352B  INR  C
352C  MOV  A,C
352D  CPI  14
352F  JC   1539
3532  LXI  H,8833
3535  SHLD 88F8
3538  XRA  A
3539  STA  88F7
353C  RET
353D  LXI  H,8000
3540  LXI  D,00DC
3543  MVI  M,55
3545  INX  H
3546  DCX  D
3547  MOV  A,D
3548  ORA  E
3549  JNZ  1543
354C  LXI  H,8100
354F  LXI  D,00DC
3552  MVI  M,55
3554  INX  H
3555  DCX  D
3556  MOV  A,D
3557  ORA  E
3558  JNZ  1552
355B  RET
355C  CALL 153D
355F  MVI  C,60
3561  LXI  D,0000
3564  LXI  H,8000
3567  SHLD 88FA
356A  LXI  H,8100
356D  SHLD 88FC
3570  LDA  88AA
3573  ORI  F8
3575  STA  A805
3578  LXI  H,0BB8
357B  SHLD 88AF.
357E  IN   80
3580  RAL
3581  ANI  60
3583  CPI  60
3585  JZ   1593
3588  LHLD 88AF
358B  MOV  A,H
358C  ANA  A
358D  JP   157E
3590  JMP  15F1
3593  IN   80
3595  RAL
3596  ANI  60
3598  CPI  60
359A  JNZ  00B1
359D  LHLD 88AF
35A0  MOV  A,H
35A1  ANA  A
35A2  JP   1593
35A5  JMP  15F1
35A8  CALL 153D
35AB  MVI  C,60
35AD  LXI  D,0000
35B0  LXI  H,8000
35B3  SHLD 88FA
35B6  LXI  H,8100
35B9  SHLD 88FC
35BC  LDA  88AA
35BF  ORI  F8
35C1  STA  A805
35C4  LXI  H,0BB8
35C7  SHLD 88AF
35CA  IN   80
35CC  RAR
35CD  ANI  60
35CF  CPI  60
35D1  JZ   15DF
35D4  LHLD 88AF
35D7  MOV  A,H
35D8  ANA  A
35D9  JP   15CA
35DC  JMP  15F1
35DF  IN   80
```

```
35E1  RAR
35E2  ANI  60
35E4  CPI  60
35E6  JNZ  00B1
35E9  LHLD 88AF
35EC  MOV  A,H
35ED  ANA  A
35EE  JP   15DF
35F1  MVI  A,FF
35F3  RET
35F4  XTHL
35F5  RET
35F6  LXI  H,889C
35F9  JMP  0CA6
35FC  RST  07
35FD  RST  07
35FE  RST  07
35FF  RST  07
3600  LXI  H,8897
3603  MVI  M,01
3605  XRA  A
3606  STA  8251
3609  STA  8250
360C  STA  824F
360F  STA  824E
3612  STA  80FF
3615  STA  80FE
3618  LDA  824E
361B  CPI  00
361D  JNZ  1654
3620  CALL 1860
3623  LXI  H,824F
3626  INR  M
3627  MVI  A,04
3629  CMP  M
362A  JNC  1620
362D  MVI  M,00
362F  INX  H
3630  INR  M
3631  MVI  A,04
3633  CMP  M
3634  JNC  1620
3637  MVI  M,00
3639  INX  H
363A  INR  M
363B  MVI  A,03
363D  CMP  M
363E  JNC  1620
3641  XRA  A
3642  MOV  M,A
3643  CALL 120A
3646  JZ   1643
3649  MVI  A,FF
364B  STA  824E
364E  CALL 0318
3651  JMP  12A7
3654  CALL 16A0
3657  CALL 120A
365A  JNZ  12A7
365D  JMP  1654
3660  NOP
3661  NOP
3662  NOP
3663  NOP
3664  NOP
3665  NOP
3666  NOP
3667  NOP
3668  NOP
3669  NOP
366A  NOP
366B  NOP
366C  NOP
366D  NOP
366E  NOP
366F  NOP
3670  NOP
3671  NOP
3672  NOP
3673  NOP
3674  NOP
3675  NOP
3676  NOP
3677  NOP
3678  NOP
3679  NOP
367A  NOP
367B  NOP
367C  NOP
367D  NOP
367E  NOP
367F  NOP
3680  NOP
3681  NOP
3682  NOP
3683  NOP
3684  NOP
3685  NOP
3686  NOP
3687  NOP
3688  NOP
3689  NOP
368A  NOP
368B  NOP
368C  NOP
368D  NOP
368E  NOP
368F  NOP
3690  NOP
3691  NOP
3692  NOP
3693  NOP
3694  NOP
3695  NOP
```

```
3696  NOP
3697  NOP
3698  NOP
3699  NOP
369A  NOP
369B  NOP
369C  NOP
369D  NOP
369E  NOP
369F  NOP
36A0  LDA   80FE
36A3  ANA   A
36A4  JZ    16AA
36A7  CALL  16C5
36AA  RET
36AB  JZ    16B7
36AE  SUI   01
36B0  STA   80FD
36B3  CALL  16C5
36B6  RET
36B7  MVI   A,00
36B9  STA   80FE
36BC  MVI   A,80
36BE  STA   80FD
36C1  RET
36C2  NOP
36C3  NOP
36C4  NOP
36C5  LDA   80FF
36C8  XRI   FF
36CA  STA   80FF
36CD  JNZ   16D4
36D0  CALL  16F0
36D3  RET
36D4  CALL  16D8
36D7  RET
36D8  LXI   H,0140
36DB  MVI   A,03
36DD  CALL  1790
36E0  MVI   A,FF
36E2  STA   A805
36E5  IN    80
36E7  DCX   H
36E8  MOV   A,H
36E9  ORA   L
36EA  JNZ   16DB
36ED  RET
36EE  RST   07
36EF  RST   07
36F0  LXI   H,0040
36F3  MVI   A,03
36F5  CALL  1790
36F8  DCX   H
36F9  MOV   A,H
36FA  ORA   L
36FB  JNZ   16F3
36FE  RET
```

```
~~36FF  RST   07~~
3700  LHLD  88AA
3703  MVI   H,00
3705  DAD   H
3706  ANA   A
3707  NOP
3708  NOP
3709  JZ    170D
370C  INX   H
370D  XCHG
370E  LXI   H,88AB
3711  MOV   M,E
3712  RET
3713  MVI   M,FF
3715  CALL  0368
3718  RET
3719  RST   07
371A  RST   07
371B  MVI   A,00
371D  STA   88F7
3720  LXI   H,0640
3723  SHLD  88AF
3726  CALL  1740
3729  MVI   C,00
372B  CALL  14D1
372E  CALL  1890
3731  CALL  18C0
3734  JNZ   1729
3737  RET
3738  RST   07
3739  RST   07
373A  RST   07
373B  RST   07
373C  RST   07
373D  RST   07
373E  RST   07
373F  RST   07
3740  LHLD  88AA
3743  MVI   H,00
3745  LXI   B,883D
3748  DAD   B
3749  PUSH  H
374A  LHLD  88AB
374D  MOV   A,L
374E  POP   H
374F  ANI   01
3751  JZ    1758
3754  LXI   B,0032
3757  DAD   B
3758  MVI   M,1F
375A  LXI   B,0019
375D  DAD   B
375E  MVI   M,1F
3760  RET
3761  RST   07
3762  RST   07
3763  RST   07
```

```
3764  RST  07
3765  RST  07
3766  RST  07
3767  RST  07
3768  RST  07
3769  RST  07
376A  RST  07
376B  RST  07
376C  RST  07
376D  RST  07
376E  RST  07
376F  RST  07
3770  LXI  H,88A3
3773  MVI  M,FF
3775  INX  H
3776  MVI  M,00
3778  LXI  H,8252
377B  MVI  C,04
377D  MOV  A,M
377E  INX  H
377F  ORA  M
3780  DCR  C
3781  JNZ  177E
3784  ANI  0F
3786  JNZ  0D3B
3789  LXI  H,11DF
378C  POP  PSW
378D  XTHL
378E  RET
378F  NOP
3790  PUSH H
3791  PUSH B
3792  PUSH D
3793  PUSH PSW
3794  PUSH PSW
3795  MVI  C,00
3797  CALL 14D1
379A  POP  PSW
379B  SUI  01
379D  JNZ  1794
37A0  POP  PSW
37A1  SUI  01
37A3  JNZ  1793
37A6  POP  D
37A7  POP  B
37A8  POP  H
37A9  RET
37AA  NOP
37AB  NOP
37AC  NOP
37AD  NOP
37AE  NOP
37AF  RST  07
37B0  CALL 0F8B
37B3  LXI  H,8257
37B6  XRA  A
37B7  ORA  M
37B8  INX  H
37B9  PUSH PSW
37BA  LXI  D,8833
37BD  MOV  A,H
37BE  SUB  D
37BF  JZ   17C6
37C2  POP  PSW
37C3  JMP  17B7
37C6  MOV  A,L
37C7  SUB  E
37C8  JZ   17CF
37CB  POP  PSW
37CC  JMP  17B7
37CF  POP  PSW
37D0  JZ   17D4
37D3  RET
37D4  POP  PSW
37D5  JMP  1605
37D8  NOP
37D9  NOP
37DA  NOP
37DB  NOP
37DC  NOP
37DD  NOP
37DE  NOP
37DF  NOP
37E0  NOP
37E1  NOP
37E2  LDA  88B1
37E5  CPI  5A
37E7  JNZ  17F5
37EA  LDA  8897
37ED  CPI  00
37EF  JNZ  17F5
37F2  JMP  0C1B
37F5  RET
37F6  RST  07
37F7  RST  07
37F8  RST  07
37F9  RST  07
37FA  RST  07
37FB  RST  07
37FC  RST  07
37FD  RST  07
37FE  RST  07
37FF  RST  07
3800  PUSH H
3801  PUSH PSW
3802  LDA  8898
3805  ORI  02
3807  STA  8898
380A  MVI  A,40
380C  STA  9001
380F  LDA  9000
3812  STA  88B1
3815  CPI  18
3817  JZ   181D
```

```
381A  CALL 1830
381D  POP  PSW
381E  POP  H
381F  EI
3820  RET
3821  NOP
3822  NOP
3823  NOP
3824  NOP
3825  NOP
3826  NOP
3827  NOP
3828  NOP
3829  NOP
382A  NOP
382B  NOP
382C  NOP
382D  NOP
382E  NOP
382F  NOP
3830  LXI  H,0070
3833  MVI  A,08
3835  CALL 1850
3838  MVI  A,FF
383A  STA  A805
383D  IN   80
383F  DCX  H
3840  MOV  A,H
3841  ORA  L
3842  JNZ  1833
3845  RET
3846  NOP
3847  NOP
3848  NOP
3849  NOP
384A  NOP
384B  NOP
384C  NOP
384D  NOP
384E  NOP
384F  NOP
3850  ANA  A
3851  PUSH PSW
3852  SUI  01
3854  JNZ  1852
3857  POP  PSW
3858  SUI  01
385A  JNZ  1851
385D  RET
385E  RST  07
385F  RST  07
3860  LXI  H,8251
3863  MOV  E,M
3864  MVI  D,00
3866  LXI  H,0019
3869  CALL 1342
386C  PUSH H
386D  LXI  H,824F
3870  MOV  E,M
3871  LXI  H,0005
3874  CALL 1342
3877  POP  B
3878  DAD  B
3879  MOV  A,L
387A  LXI  H,8250
387D  ADD  M
387E  MOV  E,A
387F  LXI  H,0180
3882  DAD  D
3883  MOV  A,M
3884  LXI  H,8833
3887  DAD  D
3888  MOV  M,A
3889  RET
388A  RST  07
388B  RST  07
388C  RST  07
388D  RST  07
388E  RST  07
388F  RST  07
3890  LDA  8898
3893  ANI  04
3895  CPI  00
3897  JZ   1890
389A  LDA  8898
389D  ANI  FB
389F  STA  8898
38A2  RET
38A3  RST  07
38A4  RST  07
38A5  RST  07
38A6  RST  07
38A7  RST  07
38A8  RST  07
38A9  RST  07
38AA  RST  07
38AB  RST  07
38AC  RST  07
38AD  RST  07
38AE  RST  07
38AF  RST  07
38B0  RST  07
38B1  RST  07
38B2  RST  07
38B3  RST  07
38B4  RST  07
38B5  RST  07
38B6  RST  07
38B7  RST  07
38B8  RST  07
38B9  RST  07
38BA  RST  07
38BB  RST  07
38BC  RST  07
```

```
38BD  RST  07
38BE  RST  07
38BF  RST  07
38C0  LHLD 88AF
38C3  MOV  A,H
38C4  ORA  L
38C5  RET
38C6  RST  07
38C7  RST  07
38C8  RST  07
38C9  RST  07
38CA  RST  07
38CB  RST  07
38CC  RST  07
38CD  RST  07
38CE  RST  07
38CF  RST  07
38D0  LDA  88B1
38D3  CPI  18
38D5  JNZ  0AE9
38D8  LDA  80FE
38DB  XRI  FF
38DD  STA  80FE
38E0  RET
38E1  LDA  889F
38E4  CPI  20
38E6  JNZ  18F3
38E9  MVI  A,01
38EB  STA  889F
38EE  PUSH B
38EF  CALL 0318
38F2  POP  B
38F3  CALL 0721
38F6  JMP  08FF
38F9  RST  07
38FA  RST  07
38FB  RST  07
38FC  RST  07
38FD  RST  07
38FE  RST  07
38FF  RST  07
3900  STA  88F5
3903  LDA  88F4
3906  ANA  A
3907  JZ   1936
390A  CPI  F0
390C  JZ   1917
390F  MVI  C,01
3911  CALL 08B0
3914  JMP  191C
3917  MVI  C,00
3919  CALL 08B0
391C  LDA  88F5
391F  ANA  A
3920  JZ   1936
3923  CPI  F0
3925  JZ   1930
3928  MVI  C,01
392A  CALL 08B0
392D  JMP  1936
3930  MVI  C,00
3932  CALL 08B0
3935  NOP
3936  RET
3937  RST  07
3938  RST  07
3939  RST  07
393A  RST  07
393B  RST  07
393C  RST  07
393D  RST  07
393E  RST  07
393F  RST  07
3940  RST  07
3941  RST  07
3942  RST  07
3943  RST  07
3944  RST  07
3945  RST  07
3946  RST  07
3947  RST  07
3948  RST  07
3949  RST  07
394A  RST  07
394B  RST  07
394C  RST  07
394D  PUSH PSW
394E  PUSH H
394F  PUSH B
3950  LXI  H,0040
3953  SHLD 81FE
3956  MVI  C,08
3958  MVI  A,0E
395A  STA  81FD
395D  CALL 1990
3960  LXI  H,81FD
3963  INR  M
3964  DCR  C
3965  JNZ  195D
3968  POP  B
3969  POP  H
396A  POP  PSW
396B  LXI  H,88AE
396E  RET
396F  PUSH PSW
3970  PUSH H
3971  PUSH B
3972  LXI  H,0040
3975  SHLD 81FE
3978  MVI  C,08
397A  MVI  A,15
397C  STA  81FD
397F  CALL 1990
3982  LXI  H,81FD
```

```
3985  DCR  M
3986  DCR  C
3987  JNZ  197F
398A  POP  B
398B  POP  H
398C  POP  PSW
398D  RET
398E  RST  07
398F  RST  07
3990  LHLD 81FE
3993  XCHG
3994  LXI  H,81FD
3997  MOV  A,M
3998  CALL 1850
399B  MVI  A,FF
399D  STA  A805
39A0  IN   80
39A2  DCX  D
39A3  MOV  A,D
39A4  ORA  E
39A5  JNZ  1994
39A8  RET
39A9  LDA  88B1
39AC  CPI  1A
39AE  JZ   15F6
39B1  PUSH H
39B2  LDA  88A9
39B5  ADI  5C
39B7  MOV  C,A
39B8  CALL 0232
39BB  LDA  88A0
39BE  PUSH PSW
39BF  LDA  88DD
39C2  INR  A
39C3  STA  88A0
39C6  CALL 043F
39C9  STA  88A9
39CC  DCR  A
39CD  MOV  C,A
39CE  MVI  E,01
39D0  CALL 04E3
39D3  POP  PSW
39D4  DCR  A
39D5  STA  88A0
39D8  LHLD 88DD
39DB  MOV  C,L
39DC  POP  H
39DD  MOV  E,L
39DE  MOV  D,H
39DF  INX  D
39E0  INR  C
39E1  LDA  88A0
39E4  CMP  C
39E5  JC   19EE
39E8  LDAX D
39E9  MOV  M,A
39EA  INX  H
39EB  JMP  19DF
39EE  CALL 035C
39F1  RET
39F2  STA  88A9
39F5  LDA  8897
39F8  CPI  03
39FA  JNZ  19F1
39FD  XRA  A
39FE  STA  88DD
3A01  LDA  88A0
3A04  DCR  A
3A05  LXI  H,88DD
3A08  CMP  M
3A09  JC   19F1
3A0C  LHLD 88DD
3A0F  MVI  H,00
3A11  LXI  B,8200
3A14  DAD  B
3A15  LDA  88A9
3A18  CMP  M
3A19  JZ   1A23
3A1C  LXI  H,88DD
3A1F  INR  M
3A20  JNZ  1A01
3A23  PUSH H
3A24  JMP  19BB
3A27  NOP
3A28  NOP
3A29  NOP
3A2A  NOP
3A2B  NOP
3A2C  RST  07
3A2D  RST  07
3A2E  RST  07
3A2F  RST  07
3A30
```

What is claimed is:

1. In a bingo game which is played with bingo cards, each having a set of 24 numbers between 1 and 75 under their B, I, N, G, and O columns, plus a free space under their N columns, and where each individual number on the bingo card is covered when it is called from a random number source during a bingo game and including machine readable coding along a length of card in addition to visual readable numbers thereon, an apparatus for electronically assisting a player by displaying the called numbers on each of a plurality of bingo cards with a single manual input of such called numbers comprising:

a microprocessor/storage means for storing and accessing all called numbers and each set of 24 numbers on each of a plurality of bingo cards and their position thereon;

an inputting means for the player interconnected to the microprocessor/storage means for manually inputting into storage each called number;

card holding and displaying means for holding a plurality of cards, each in a discrete position for simultaneous viewing by the player during play;

a plurality of reader means at said card holding and displaying means, each reader means interconnected to the microprocessor/storage means, for automatically reading each set of 24 numbers on at least one bingo card and inputting each set of 24 numbers into storage as each card is introduced by the player into said cardholding and displaying means for viewing by the player;

a means interconnected to the microprocessor/storage means for indicating the inputted called numbers as they exist on each of the plurality of bingo cards, and, said indicating means including visual means associated with each card positioning means and coupled to said microprocessor to visually identify on each card each number called as manually inputted by the player;

a means for manually enabling the erasing from storage of all called numbers after the end of each bingo game;

thus, the apparatus electronically assists the player by displaying the called numbers as they exist on each of the plurality of bingo cards with a single manual input of each of said called numbers.

2. The apparatus in accordance with claim 1 further including means for interconnecting at least two apparatus where one such apparatus acts as a master apparatus and the others as slave apparatus so that the inputting means of the master apparatus inputs called numbers into its own storage and the storage of each of the slave apparatus, and the player's manual input of called numbers in the master apparatus causes the master and slave apparatus to display the called numbers as they exist on all of the plurality of bingo cards by the master and slave apparatus;

wherein said apparatus includes serial interface circuit means whereby said master apparatus and slave apparatus are interchangable and wherein interconnection establishes the master slave relationship.

3. The apparatus in accordance with claim 1 in which said reader means includes sensor means positioned adjacent to said card holding means and the machine readable coding on each bingo card is read as the player drops each card into the holding and display means.

4. The apparatus in accordance with claim 1 further including means for verifying the correctness of the set of 24 numbers read from each bingo card;

said verifying means comprising means for reading a card identification as each card is inserted into said card holding and displaying means; and means for verifying the correctness of the numbers on the card inserted; and means for enabling the visual identification of a correct card by illuminating the "free" space on the card.

5. The apparatus in accordance with claim 1 in which said bingo card includes a plurality of bingo sets thereon and the individual sets of markings, one for each set, comprises barcodes, each of which contain marking for each of the numbers in the sets of 24 numbers and verification numbers to aid in verifying the correctness of the readings of the two sets of 24 numbers;

said barcodes positioned along a side of the cards and said reader means located along the same side of said card holding and displaying means;

whereby said reader means is operative to read the barcodes as each card is introduced into the card holding and displaying means by the player in preparation for play.

6. The apparatus in accordance with claim 5 in which the bingo cards are constructed of a semi-rigid and transparent material and contain individual areas, in each of which are located individual opaque numerals representing one of the two sets of 24 numbers and the free spaces under the appropriate B, I, N, G and O columns, and the means for indicating the called numbers as they exist on each of the plurality of bingo cards comprises means interconnected to the microprocessor/storage means for lighting a light behind all individual areas in which are located numerals which have been called in a particular bingo game.

7. In a bingo game which is played with bingo cards, each having a set of 24 numbers between 1 and 75 under their B, I, N, G, and O columns, plus a free space under their N columns, and where each individual number on the bingo card is covered when it is called from a random number source during a bingo game and including machine readable coding along a length of card, an apparatus for electronically assisting a player by displaying the called numbers on each of a plurality of bingo cards with a single manual input of such called numbers comprising:

a microprocessor/storage means for storing and accessing all called numbers and each set of 24 numbers on each of a plurality of bingo cards and their position thereon;

an inputting means interconnected to the microprocessor/storage means for manually inputting into storage each called number;

card holding means;

a plurality of reader means; each reader means interconnected to the microprocessor/storage means, for automatically reading each set of 24 numbers on at least one bingo card and inputting each set of 24 numbers into storage as each card is introduced into said cardholding means;

a means interconnected to the microprocessor/storage means for indicating the inputted called numbers as they exist on each of the plurality of bingo cards, and, a means for manually enabling the erasing from storage of all called numbers after the end of each bingo game;

thus, the apparatus electronically assists the player by displaying the called numbers as they exist on each of the plurality of bingo cards with a single manual input of each of said called numbers;

further including means for verifying the correctness of the set of 24 numbers read from each bingo card;

in which the means for verifying the correctness of each of the numbers in the set of 24 numbers comprises:

means for creating a check sum by combining all of the numbers in the set of 24 numbers actually read from each bingo card;

means for reading from each bingo card a predetermined verification number which will, when subtracted from the check sum, result in a zero value if the check sum is correct;

means for subtracting the verification number from the check sum and creating a difference value;

means for indicating that the reading from the bingo card is incorrect if the difference value is other than the zero value;

means for indicating that the reading from the bingo card is correct if the difference value is equal to the zero value.

8. The apparatus in accordance with claim 7 in which the means for indicating that the reading from the bingo card is incorrect, including means for flashing a light, and the means for indicating that the reading from the bingo card is correct and comprises means for providing a continuous light.

* * * * *